US011095040B2

(12) United States Patent
Sonoda

(10) Patent No.: US 11,095,040 B2
(45) Date of Patent: Aug. 17, 2021

(54) ANTENNA AND MIMO ANTENNA

(71) Applicant: AGC Inc., Chiyoda-ku (JP)

(72) Inventor: Ryuta Sonoda, Tokyo (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 16/662,184

(22) Filed: Oct. 24, 2019

(65) Prior Publication Data

US 2020/0059009 A1 Feb. 20, 2020

Related U.S. Application Data

(63) Continuation of application No. PCT/JP2018/016328, filed on Apr. 20, 2018.

(30) Foreign Application Priority Data

Apr. 27, 2017 (JP) ..... JP2017-088786

(51) Int. Cl.

| | |
|---|---|
| ***H01Q 21/06*** | (2006.01) |
| ***H01Q 19/30*** | (2006.01) |
| ***H01Q 1/48*** | (2006.01) |
| ***H01Q 19/10*** | (2006.01) |
| ***H01Q 21/00*** | (2006.01) |
| ***H01Q 5/49*** | (2015.01) |

(52) U.S. Cl.

CPC ..... *H01Q 19/30* (2013.01); *H01Q 1/48* (2013.01); *H01Q 5/49* (2015.01); *H01Q 19/10* (2013.01); *H01Q 21/0006* (2013.01); *H01Q 21/061* (2013.01)

(58) Field of Classification Search

CPC ..... H01Q 5/49; H01Q 19/30

See application file for complete search history.

(56) References Cited

U.S. PATENT DOCUMENTS 4,290,071 A * 9/1981 Fenwick ..... H01Q 5/00 343/815

5,061,944 A * 10/1991 Powers ..... H01Q 19/30 343/795

(Continued)

FOREIGN PATENT DOCUMENTS

CN 101005153 A 7/2007

CN 102055064 A 5/2011

(Continued)

OTHER PUBLICATIONS

Written Opinion dated Jul. 3, 2018 in PCT/JP2018/016328 filed on Apr. 20, 2018.

*Primary Examiner* — Ab Salam Alkassim, Jr.

(74) *Attorney, Agent, or Firm* — Oblon, McClelland, Maier & Neustadt, L.L.P.

(57) ABSTRACT

An antenna includes a ground plane, a first resonator connected to a feeding point for which the ground plane serves as a reference, a second resonator configured to receive power from the first resonator through electromagnetic coupling or magnetic coupling in a contactless manner, at least one director located away from the first resonator and the second resonator, and wherein the ground plane located at a side opposite to the director with respect to the second resonator is used as a reflector, or the antenna further comprises a reflector located at the side opposite to the director with respect to the second resonator.

20 Claims, 18 Drawing Sheets

(56) References Cited

U.S. PATENT DOCUMENTS 5,220,335 A * 6/1993 Huang ..... H01Q 1/38 343/700 MS
6,025,811 A * 2/2000 Canora ..... H01Q 1/36 343/793
6,191,751 B1 * 2/2001 Johnson ..... H01Q 1/3291 343/713
6,326,922 B1 * 12/2001 Hegendoerfer ..... H01Q 1/38 343/700 MS
9,116,239 B1 * 8/2015 Billsberry ..... H01Q 21/28
9,246,235 B2 * 1/2016 Smith ..... H01Q 3/242
9,515,377 B2 * 12/2016 Zhang ..... H01Q 9/16
10,103,424 B2 * 10/2018 Noori ..... H01Q 1/243
2003/0160730 A1 * 8/2003 Alsliety ..... H01Q 19/30 343/818
2004/0066341 A1 * 4/2004 Ito ..... H01Q 9/42 343/702
2008/0272976 A1 * 11/2008 Kitamori ..... H01Q 9/285 343/793
2011/0090131 A1 * 4/2011 Chen ..... H01Q 19/30 343/815
2012/0293387 A1 * 11/2012 Ohno ..... H01Q 9/285 343/818
2013/0027268 A1 * 1/2013 Ohno ..... H01Q 9/285 343/818
2015/0130669 A1 * 5/2015 Sonoda ..... H01Q 7/00 343/702
2015/0171522 A1 * 6/2015 Liu ..... H01Q 5/42 343/796
2016/0043473 A1 * 2/2016 Walker ..... H01Q 1/38 343/835
2016/0189915 A1 * 6/2016 Kim ..... H01Q 1/38 315/34
2016/0322702 A1 * 11/2016 Sayama ..... H01Q 3/28
2017/0194692 A1 * 7/2017 Sayama ..... H01Q 5/378
2017/0309991 A1 * 10/2017 Noori ..... H01Q 1/241
2017/0309992 A1 * 10/2017 Noori ..... H01Q 1/2258
2018/0266945 A1 * 9/2018 Kitaura ..... G01J 1/0252
2019/0044239 A1 * 2/2019 Sonoda ..... H01Q 9/30
2019/0237861 A1 * 8/2019 Kim ..... H01Q 21/065

FOREIGN PATENT DOCUMENTS

CN 104508907 A 4/2015
DE 21 35 384 C2 10/1982
JP 2009-200719 A 9/2009
JP WO 20091050833 2/2011
JP 2011-049864 A 3/2011
WO WO 2007/097282 A1 8/2007
WO WO 2009/050883 A1 4/2009
WO WO 2016/052733 A1 4/2016

* cited by examiner

Frequency = 28
Main lobe magnitude = 3.9 dBi
Main lobe direction = 93.0 deg.
Angular width (3 dB) = 112.9 deg.
Side lobe level = −4.8 dB Frequency = 28
Main lobe magnitude = 3.89 dBi
Main lobe direction = 86.0 deg.
Angular width (3 dB) = 124.6 deg.

Frequency = 28
Main lobe magnitude = 4.42 dBi
Main lobe direction = 95.0 deg.
Angular width (3 dB) = 109.6 deg.
Side lobe level = −8.4 dB Frequency = 28
Main lobe magnitude = 4.37 dBi
Main lobe direction = 87.0 deg.
Angular width (3 dB) = 99.1 deg.
Side lobe level = −10.0 dB Frequency = 28
Main lobe magnitude = 5.11 dBi
Main lobe direction = 99.0 deg.
Angular width (3 dB) = 75.9 deg.
Side lobe level = −6.5 dB Frequency = 28
Main lobe magnitude = 4.96 dBi
Main lobe direction = 90.0 deg.
Angular width (3 dB) = 86.5 deg.
Side lobe level = −6.4 dB

ANTENNA AND MIMO ANTENNA

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2018/016328 filed on Apr. 20, 2018 and designating the U.S., which claims priority of Japanese Patent Application No. 2017-088786 filed on Apr. 27, 2017. The entire contents of the foregoing applications are incorporated herein by reference.

BACKGROUND OF THE INVENTION

1. Field of the Invention

The disclosure herein generally relates to an antenna and MIMO (Multiple Input and Multiple Output) antenna.

2. Description of the Related Art

Conventionally, a flat Yagi-Uda antenna having a directivity in a direction parallel with a circuit board is known (for example, see Japanese Laid-Open Patent Publication No. 2009-200719).

In the technique described in Japanese Laid-Open Patent Publication No. 2009-200719, a balun is used to connect a balanced antenna portion and an unbalanced transmission line. However, a space for the balun may not be always available.

SUMMARY OF THE INVENTION

Accordingly, the present disclosure provides an antenna capable of obtaining a directivity in a particular direction without a balun.

According to an aspect of the present disclosure, an antenna includes a ground plane, a first resonator connected to a feeding point for which the ground plane serves as a reference, a second resonator configured to receive power from the first resonator through electromagnetic coupling or magnetic coupling in a contactless manner, at least one director located away from the first resonator and the second resonator, and wherein the ground plane located at a side opposite to the director with respect to the second resonator is used as a reflector, or the antenna further comprises a reflector located at the side opposite to the director with respect to the second resonator.

According to the present disclosure, a directivity in a particular direction can be obtained even without a balun. By applying the present invention to a portable information device, the size of the device can be reduced, and furthermore, the performance of the antenna can be enhanced. As a result, the flexibility in the design of the device can be improved, and the design can be improved.

BRIEF DESCRIPTION OF THE DRAWINGS

Other objects and further features of embodiments will become apparent from the following detailed description when read in conjunction with the accompanying drawings, in which.

DETAILED DESCRIPTION OF THE PREFERRED EMBODIMENTS

Hereinafter, embodiments of the present invention will be explained with reference to drawings. In the following explanation, an X axis, a Y axis, and a Z axis represent axes perpendicular to each other, and the X axis direction, the Y axis direction, and Z axis direction represent directions in parallel with the X axis, the Y axis, and the Z axis.

Figure 1:
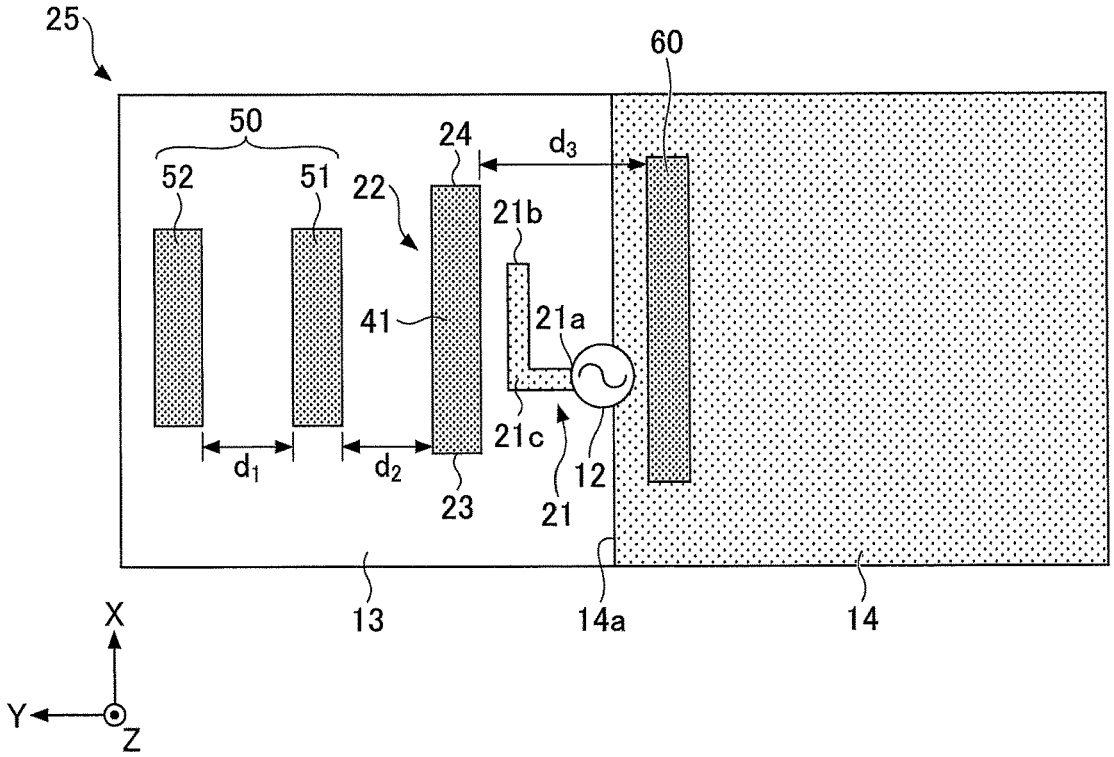
FIG. 1 is a plan view schematically illustrating an example of a configuration of an antenna according to the present disclosure.
Figure 2:
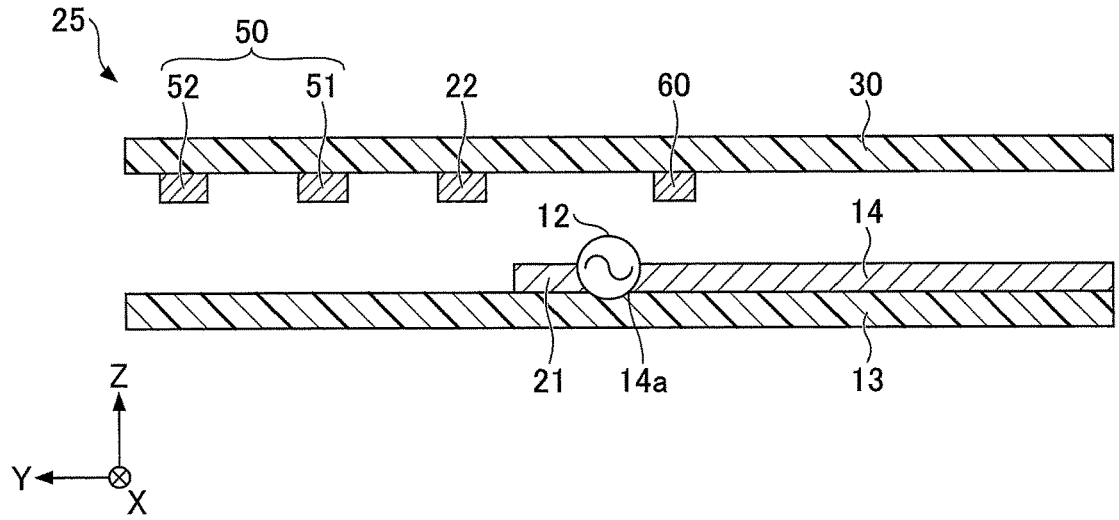
FIG. 2 is a cross sectional view schematically illustrating an example of a configuration of the antenna according to the present disclosure.

FIG. 1 is a plan view schematically illustrating an example of a configuration of an antenna according to the present disclosure. FIG. 2 is a cross sectional view schematically illustrating an example of a configuration of the antenna according to the present disclosure. An antenna 25 illustrated in FIGS. 1, 2 is provided on an electronic device having wireless communication function. The electronic device performs wireless communication by using the antenna 25. Examples of electronic devices equipped with the antenna 25 include wireless terminal devices (e.g., cellular phones, smartphones, IoT (Internet of Things) devices, and the like) and wireless base stations.

The antenna 25 supports, for example, the fifth generation mobile communication system (so-called 5G), wireless communication specifications such as Bluetooth (registered trademark), and wireless LAN (Local Area Network) specifications such as IEEE 802.11ac. The antenna 25 is configured to be able to transmit and receive, for example, radio waves in SHF (Super High Frequency) band of which frequency is 3 to 30 GHz and radio waves in EHF (Extremely High Frequency) band of which frequency is 30 to 300 GHz. The antenna 25 is connected to an end of an unbalanced transmission line using a ground 14.

Examples of transmission lines include microstrip lines, strip lines, and coplanar waveguides with ground planes (coplanar waveguides with ground planes on the surface opposite to the conductor surface where signal lines are formed), coplanar strip lines, and the like.

The antenna 25 includes a ground 14, a feeding element 21, and a radiation element 22.

The ground 14 is an example of a ground plane. The ground outer edge 14*a* extends in the X axis direction, and is an example of straight outer edge of the ground 14. The ground 14 is arranged in parallel with the XY plane including the X axis and the Y axis. For example, the ground 14 is a ground pattern formed on the circuit board 13 in parallel with the XY plane.

The circuit board 13 is a member mainly composed of a dielectric. An example of the circuit board 13 is an FR4 (Flame Retardant Type4) circuit board. The circuit board 13 may be a flexible circuit board having flexibility. The circuit board 13 includes a first circuit board surface and a second circuit board surface opposite to the first circuit board surface. For example, electronic circuits are implemented on the first circuit board surface, and the ground 14 is formed on the second circuit board surface. It should be noted that the ground 14 may be formed either on the first circuit board surface or in the inside of the circuit board 13.

The electronic circuit implemented on the circuit board 13 is an integrated circuit including, for example, at least one of the reception function for receiving signals via the antenna 25 and the transmission function for transmitting signals via the antenna 25. The electronic circuit is implemented with, for example, an IC (Integrated Circuit) chip. An integrated circuit including at least one of the reception function and the transmission function is also referred to as a communication IC.

The feeding element 21 is an example of a first resonator connected to a feeding point with the ground plane serving as a reference. The feeding element 21 is connected to the end 12 of the transmission line. The end 12 is an example of a feeding point with the ground 14 serving as the ground reference.

The feeding element 21 may be arranged on the circuit board 13, or may be arranged at a portion other than the circuit board 13. In a case where the feeding element 21 is arranged on the circuit board 13, the feeding element 21 is, for example, a conductor pattern formed on the first circuit board surface of the circuit board 13.

The feeding element 21 extends in a direction away from the ground 14, and is connected to the feeding point (end 12) with the ground 14 as the ground reference. The feeding element 21 is a linear conductor capable of feeding power to the radiation element 22 by contactlessly coupling with the radiation element 22 in terms of radio frequency. In FIGS. 1, 2, for example, the feeding element 21 is formed in an L shape constituted by a linear conductor extending in a direction perpendicular to the ground outer edge 14*a* and a linear conductor extending along the ground outer edge 14*a*. In FIGS. 1, 2, the feeding element 21 starts from the end 12 to extend from an end 21*a* to a bent portion 21*c*, bends at the bent portion 21*c*, and extends to an end 21*b*. The end 21*b* is an open end to which any other conductor is not connected. The feeding element 21 includes a conductor portion having a directional component in parallel with the X axis. FIGS. 1, 2 illustrate the feeding element 21 in the L shape as an example, but the shape of the feeding element 21 may be other shapes such as linear, meander, or loop shapes.

The radiation element 22 is an example of a second resonator in proximity with the first resonator. For example, the radiation element 22 is arranged away from the feeding element 21, and functions as a radiation conductor by the excitation caused by the feeding element 21. For example, the radiation element 22 functions as a radiation conductor to which power is fed contactlessly through electromagnetic coupling or magnetic coupling with the feeding element 21. The electromagnetic coupling means contactless coupling by electromagnetic waves. The magnetic coupling means contactless coupling by electromagnetic coupling or electromagnetic induction.

More specifically, in the present invention, among the contactless coupling, electrostatic capacitive coupling (which may also be hereinafter simply referred to as electrostatic coupling or capacitive coupling) is excluded. This is because, like a case where the electrostatic capacity value changes as the distance between flat capacitors changes, when electrostatic capacitive coupling occurs between two conductors, the value of electrostatic capacity formed between the two conductors changes according to variation of the distance, and the resonance frequency also changes according to the change of the value of the electrostatic capacity. In other words, for the electromagnetic coupling being made, the change of the resonance frequency caused by variation of the distance can be suppressed to, preferably within 10%, more preferably within 5%, and still more preferably within 3%.

When electrostatic capacitive coupling occurs between two conductors, a displacement current flows between two conductors (just like a displacement current flowing between two conductors in a parallel plate capacitor), and the two conductors act as a single resonator rather than acting as separate resonators.

It should be noted that "the electrostatic capacitive coupling is excluded" means that electrostatic capacitive coupling is not present in a manner of dominating actual coupling, and more specifically, this means that matters regarding electrostatic capacitive coupling can be disregarded as long as each of two conductors separately act as a resonator.

The radiation element 22 includes a conductor portion having a directional component in parallel with the X axis. For example, the radiation element 22 includes a conductor portion 41 extending along the ground outer edge 14*a* in parallel with the X axis direction. The conductor portion 41 is located away from the ground outer edge 14*a*. Since the radiation element 22 includes the conductor portion 41 along the ground outer edge 14*a*, for example, the directivity of the antenna 25 can be easily adjusted.

The feeding element 21 and the radiation element 22 are arranged away from each other by a distance that allows electromagnetic coupling with each other. The radiation element 22 includes a feeding part to which power is fed from the feeding element 21. In FIGS. 1, 2, the conductor portion 41 is shown as a feeding part. The radiation element 22 receives power with the feeding part via the feeding element 21 through electromagnetic coupling in a contactless manner. Since the power is fed in this manner, the radiation element 22 functions as the radiation conductor of the antenna 25.

Since the radiation element 22 receives power via the feeding element 21 through electromagnetic coupling in a contactless manner, a resonance current (i.e., a current distributed in a form of a standing wave between an end 23 and the other end 24) similar to that on a half-wave dipole antenna flows in the radiation element 22. In other words, since the radiation element 22 receives power via the feeding element 21 through electromagnetic coupling in a contactless manner, the radiation element 22 functions as a dipole antenna.

Therefore, since the radiation element 22 receives power via the feeding element 21 through electromagnetic coupling in a contactless manner, the antenna 25 can be connected to an unbalanced transmission line without a balun. Likewise, when the radiation element 22 receives power via the feeding element 21 through magnetic coupling in a contactless manner, the antenna 25 can be connected to an unbalanced transmission line without a balun. When the operation frequency of an antenna is increased to 6 GHz or more, it may be considered to provide the antenna and the communication IC on the same circuit board in order to reduce the transmission loss between the communication IC and the antenna. In such a case, an antenna circuit board material is desired to be selected in view of heat generated from the communication IC, but according to the present technique, the communication IC and the antenna can be connected with a physical separation therebetween, which can prevent heat conduction to the antenna, and allows a wide range of choices for the antenna circuit board (for example, a base plate 30). For example, resins with low heat resistance can be used for the antenna circuit board material.

The radiation element 22 is provided on the base plate 30 having dielectric property. The base plate 30 is, for example, a circuit board having a flat portion. A portion or all of the radiation element 22 may be provided on the surface of the base plate 30, or in the inside of the base plate 30. In FIGS. 1, 2, the radiation element 22 is arranged on the inner surface of the base plate 30 (i.e., a surface facing the ground 14). The base plate 30 is preferably made of a low dielectric loss material. With such configuration, the antenna performance can be improved. Since it is not necessary to form the antenna on the circuit board 13, generally-available circuit board materials such as FR4 can be used for the circuit board 13.

The antenna 25 is configured to include a flat Yagi-Uda antenna including the radiation element 22, a director 50, and a reflector 60. The radiation element 22 functions as a radiation device (radiator). The director 50 and the reflector 60 are conductor elements arranged away from the feeding element 21 and the radiation element 22.

The antenna 25 includes at least one director 50 located in a particular direction (i.e., in FIGS. 1, 2, the positive side in the Y axis direction in parallel with the ground 14) with respect to the radiation element 22. The director 50 includes a conductor portion having a directional component in parallel with the X axis. In FIGS. 1, 2, two directors 51, 52 are illustrated. Each of the lengths of the directors 51, 52 is shorter than the length of the radiation element 22. The director may also be referred to as a directing element.

The lengths of the radiation element 22 and the directing elements 51, 52 are denoted as $L_{22}$, $L_{51}$, $L_{52}$, respectively. $L_{51}$ is preferably 0.8 to 0.99 times the length of $L_{22}$, and is more preferably 0.85 to 0.95 times the length of $L_{22}$. Likewise, $L_{52}$ is preferably shorter than $L_{51}$. $L_{52}$ is preferably 0.8 to 0.99 times the length of $L_{51}$, and is more preferably 0.85 to 0.95 times the length of $L_{51}$. FIGS. 1, 2 illustrate an example where there are two directing elements. But the number of directing elements may be three or more, and in such a case, while a relationship between $L_{51}$ and $L_{52}$ is maintained, the lengths of the directing elements are preferably gradually reduced from the negative side to the positive side in the Y axis direction.

The radiation element 22 and the directing elements 51, 52 are preferably arranged in parallel or substantially in parallel, and where the wavelength in resonance is denoted as $\lambda$, any of the distances therebetween d1, d2 (i.e., the minimum distances between two elements) is preferably $0.2\lambda$ to $0.3\lambda$, and more preferably $0.23\lambda$ to $0.27\lambda$.

The directors 51, 52 are provided on the base plate 30, and in FIGS. 1, 2, and are arranged on the inner surface of the base plate 30. In FIGS. 1, 2, the directors 51, 52 are arranged on the same surface as the surface on which the radiation element 22 is provided.

The antenna 25 includes at least one reflector 60 located at the side opposite to the director 50 with respect to the radiation element 22. The reflector 60 includes a conductor portion having a directional component in parallel with the X axis. In FIGS. 1, 2, the reflector 60 is located at the side opposite to the director 50 with respect to the radiation element 22 and the feeding element 21. Since the reflector 60 is located at a side opposite to the director 50 with respect to both of the radiation element 22 and the feeding element 21, the size of the antenna 25 can be reduced as compared with a configuration in which the reflector 60 is located at the side of the radiation element 22 with respect to the feeding element 21. The reflector may also be referred to as a reflection element.

The length of the reflector 60 is longer than the length of the radiation element 22. When the length of the reflector 60 is denoted as $L_{60}$, $L_{60}$ is preferably 1.01 to 1.2 times the length of $L_{22}$, and more preferably 1.05 to 1.15 times the length of $L_{22}$. The reflector 60 and the radiation element 22 are preferably arranged in parallel or substantially in parallel, and where the wavelength in resonance is denoted as λ, the distance therebetween d3 (i.e., the minimum distance between two elements) is preferably 0.2λ to 0.3λ, and more preferably 0.23λ to 0.27λ.

The reflector 60 is provided on the base plate 30, and in FIGS. 1, 2, and is arranged on the inner surface of the base plate 30. In FIGS. 1, 2, the reflector 60 is provided on the same surface as the radiation element 22 so as to face the ground 14. The reflector 60 is arranged to face the ground 14. As a result, the size of the antenna 25 can be reduced as compared with a configuration in which the reflector 60 is arranged in a portion that does not face the ground 14 (for example, a configuration in which the reflector 60 is located at the side of the radiation element 22 with respect to the ground outer edge 14*a*).

As described above, the antenna 25 includes at least one director 50 located in a particular direction (i.e., in FIGS. 1, 2, the positive side in the Y axis direction in parallel with the ground 14) with respect to the radiation element 22 and at least one reflector 60 located at the side opposite to the director 50 with respect to the radiation element 22. Therefore, the antenna 25 having a directivity in a particular direction (i.e., in FIGS. 1, 2, the positive side in the Y axis direction in parallel with the ground 14) with respect to the radiation element 22 can be achieved. In particular, the radiation element 22, the director 50, and the reflector 60 have conductor portions having directional components in parallel with the ground 14. Therefore, the antenna gain in the horizontal polarization can be increased in a particular direction (in FIGS. 1, 2, the positive side in the Y axis direction in parallel with the ground 14) with respect to the radiation element 22.

In FIGS. 1, 2, the antenna 25 includes the reflector 60 located at the side opposite to the director 50 with respect to the radiation element 22. Alternatively, the antenna 25 may use, as a reflector, the ground 14 located at the side opposite to the director 50 with respect to the radiation element 22. When the ground 14 is used as the reflector, the reflector 60 in FIGS. 1, 2 may not be provided. Even in this case, the antenna 25 having a directivity in a particular direction (i.e., in FIGS. 1, 2, the positive side in the Y axis direction in parallel with the ground 14) with respect to the radiation element 22 can be implemented. Still alternatively, the radiation element 22 and the director 50 may be provided on the same plane as the feeding element 21.

Figure 26:
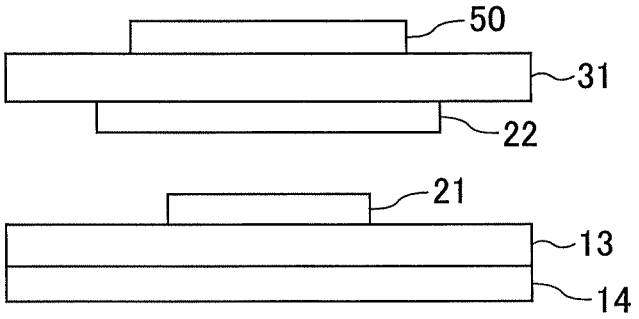
FIG. 26 is a drawing schematically illustrating an aspect in which a directing element and a radiation element are stacked with a conductor being sandwiched therebetween.

In another aspect, the directing element 50 and the radiation element 22 may be stacked with a conductor 31 (for example, a housing of a portable device and the like) being sandwiched therebetween, of which schematic drawing is illustrated in FIG. 26. In FIG. 26, the director 50 and the radiation element 22 are stacked on both surfaces of the conductor 31. FIG. 26 illustrates an example where there is one directing element 50, but the number of directing elements 50 may be two or more. In that case, a dielectric is preferably interposed between the directing elements. In a case where there are multiple directing elements, where the wavelength in resonance is denoted as λ, the distance between the directing elements is preferably 0.2λ to 0.3λ, and more preferably 0.23λ to 0.27λ. The relationship of the lengths of the directing elements, the reflection element, and the radiation element is preferably similar to that of FIG. 1.

Figure 27:
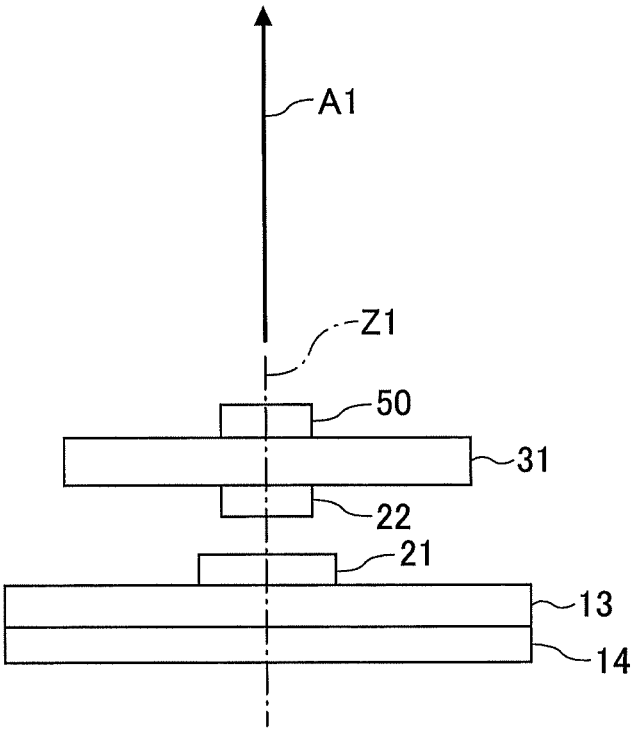
FIG. 27 is a drawing (part one) for explaining that a direction of a main beam can be controlled by adjusting a relative positional relationship of each element.
Figure 28:
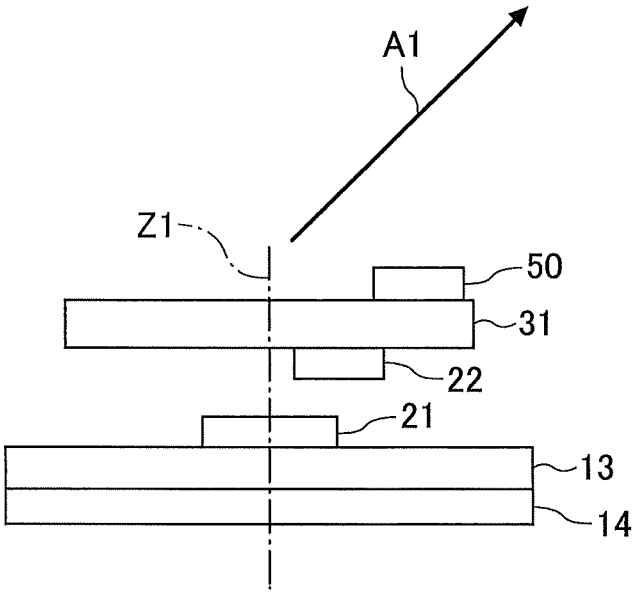
FIG. 28 is a drawing (part two) for explaining that the direction of the main beam can be controlled by adjusting the relative positional relationship of each element.

As illustrated in FIG. 27, it is also possible to control the directivity by adjusting relative positional relationship between each element while the directing element 50, the radiation element 22, and the reflection element (or the ground 14) are stacked in parallel or substantially in parallel. For example, as illustrated in FIG. 27, when the centers of the elements are linearly aligned in a direction Z1 perpendicular to the length direction of any one of the elements, the main radiation direction A1 is the direction Z1 perpendicular thereto. On the other hand, as illustrated in FIG. 28, when the centers of the elements are displaced in a stepwise manner from the direction Z1 perpendicular to the length direction of any one of the elements, the main radiation direction A1 can be inclined to the direction in which the centers of the elements are displaced in the stepwise manner. By using both of the antenna having the configuration of FIG. 27 and the antenna having the configuration of FIG. 28 at a time, a pseudo omnidirectional antenna radiating in all azimuth directions can be made.

First Embodiment

Figure 3:
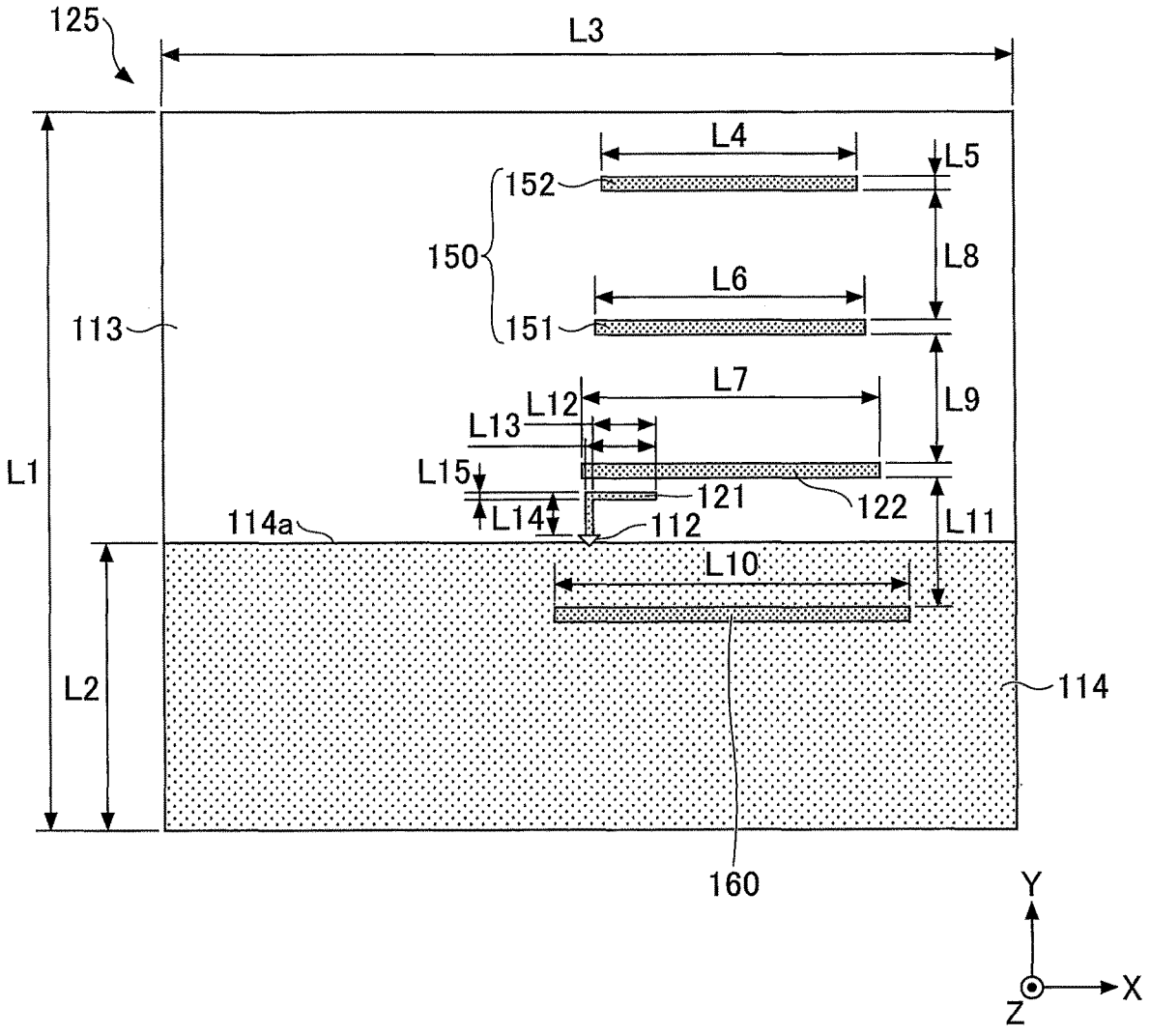
FIG. 3 is a plan view schematically illustrating a first embodiment of an antenna according to the present disclosure.
Figure 4:
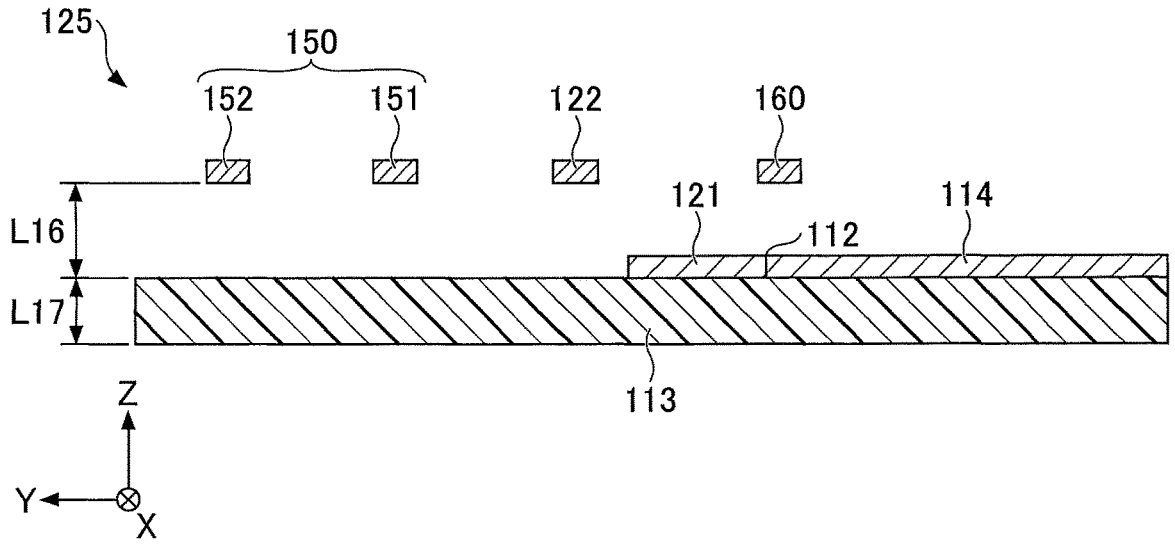
FIG. 4 is a cross sectional view schematically illustrating the first embodiment of the antenna according to the present disclosure.

FIG. 3 is a plan view schematically illustrating a first embodiment of an antenna according to the present disclosure. FIG. 4 is a cross sectional view schematically illustrating the first embodiment of the antenna according to the present disclosure. In the configurations of the first embodiment, explanations about configurations similar to the above-described configurations are omitted or simplified by incorporating the above explanations herein by reference.

In FIGS. 3, 4, an antenna 125 is an example of the antenna 25 (see FIG. 1). The antenna 125 includes a ground 114, a feeding element 121, a radiation element 122, a director 150, and a reflector 160.

The ground 114 is an example of the ground 14 (see FIG. 1). The ground outer edge 114*a* is an example of a linear outer edge of the ground 114. The ground 114 is, for example, a ground pattern formed on a circuit board 113 in parallel with the XY plane. The circuit board 113 is an example of the circuit board 13 (see FIG. 1). The feeding element 121 is an example of the feeding element 21 (see FIG. 1). The feeding element 121 is connected to an end 112 of a transmission line. The end 112 is an example of the feeding point with the ground 114 serving as the ground reference. The radiation element 122 is an example of the radiation element 22 (see FIG. 1). The radiation element 122 functions as a radiation conductor to which power is fed contactlessly through electromagnetic coupling with the feeding element 121. The director 150 is an example of the director 50 (see FIG. 1). In FIGS. 3, 4, two directors 151, 152 are illustrated. The reflector 160 is an example of the reflector 60 (see FIG. 1).

Figure 5:
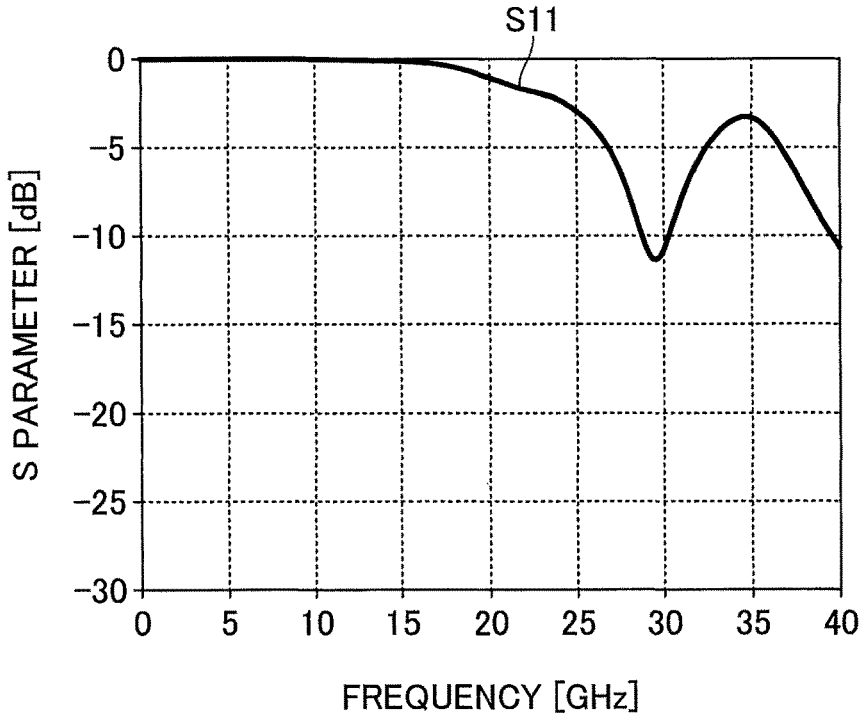
FIG. 5 is a drawing illustrating an example of a simulation analyzing return loss characteristics of the first embodiment of the antenna according to the present disclosure.

FIG. 5 is a drawing illustrating an example of simulation analyzing return loss characteristics of the antenna 125. Microwave Studio (registered trademark) (CST) is used as electromagnetic simulation. The vertical axis represents a reflection coefficient S11 of S-parameters (Scattering parameters).

The frequency at which the reflection coefficient S11 becomes a local minimum is the frequency at which impedance matching can be attained, and this frequency can be adopted as the operation frequency (resonance frequency) of the antenna 125. The frequency at which the reflection coefficient S11 becomes a local minimum is the frequency at which impedance matching can be attained, and this frequency can be adopted as the operation frequency (resonance frequency) of the antenna 125. As illustrated in FIG. 5, with the antenna 125, preferable impedance matching can be attained in a bandwidth including 28 GHz.

Figure 6:
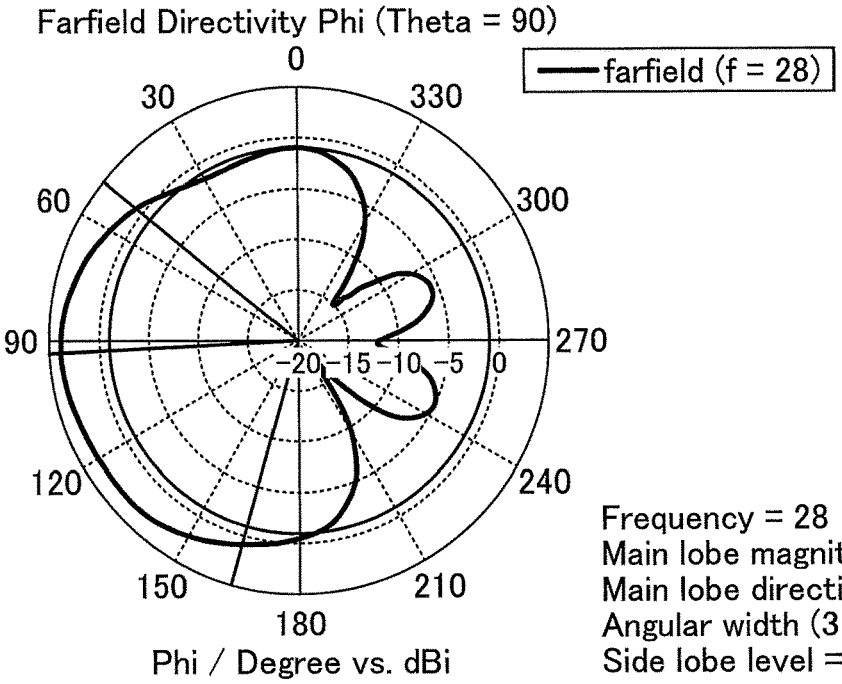
FIG. 6 is a drawing illustrating an example of a simulation result analyzing directivity within a horizontal plane when the first embodiment of the antenna according to the present disclosure is used in horizontal polarization.
Figure 7:
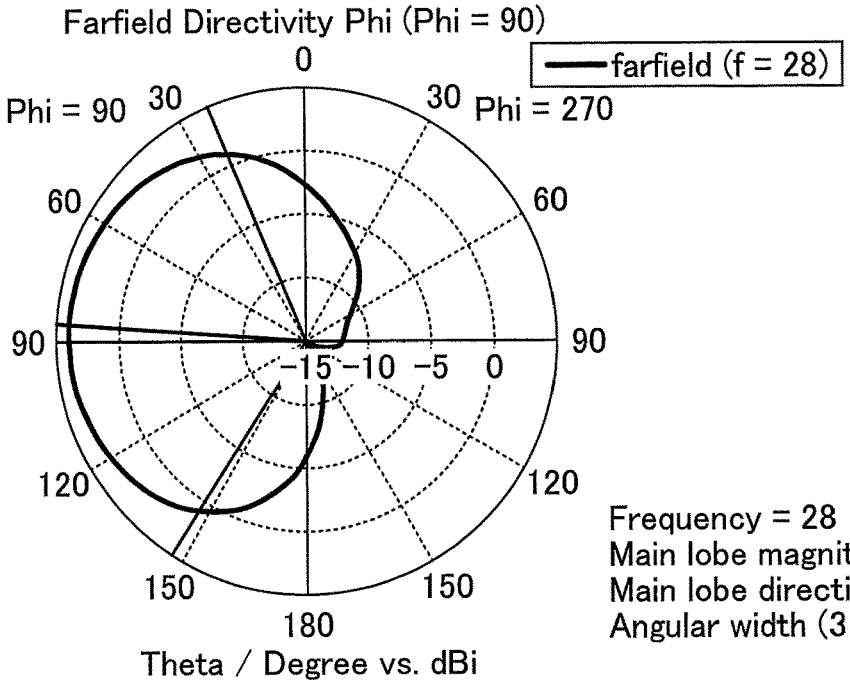
FIG. 7 is a drawing illustrating an example of a simulation result analyzing directivity within a vertical plane when the first embodiment of the antenna according to the present disclosure is used in horizontal polarization.

FIG. 6 is a drawing illustrating an example of a simulation result analyzing directivity within a horizontal plane when the antenna 125 is used in horizontal polarization. FIG. 7 is a drawing illustrating an example of a simulation result analyzing directivity within a vertical plane when the antenna 125 is used in horizontal polarization. FIGS. 6, 7 illustrate directivity gains at the resonance frequency f(=28 GHz) in the fundamental mode of the antenna 125.

In the analysis of FIGS. 6, 7, one of the ends (i.e., an end close to the feeding element 121) of the radiation element 122 of the antenna 125 is defined as an origin where the X axis, the Y axis, and the Z axis intersect. φ (Phi) represents an angle formed by the X axis and any given direction within a plane including the X axis and the Y axis. θ (Theta) represents an angle formed by the Z axis and any given direction within a plane including the Z axis and the direction represented by φ.

As illustrated in FIGS. 6, 7, the antenna 125 having directivity at the positive side in the Y axis direction with respect to the radiation element 122 can be implemented. Therefore, since the antenna 125 is arranged such that the ground 114 is in parallel with the horizontal plane, the directivity at the positive side in the Y axis direction is improved in the direction in parallel with the horizontal plane (horizontal direction). Accordingly, the antenna gain (operation gain) of horizontal polarization for reception from the positive side in the Y axis direction or radiation to the positive side in the Y axis direction can be increased.

It should be noted that, when the S parameters and the antenna gain are analyzed in FIGS. 5 to 7, the dimension of each unit illustrated in FIGS. 3, 4 is as follows, which is expressed in millimeters.

L1=10
L2=4
L3=12
L4=3.6
L5=0.12
L6=3.8
L7=4.2
L8=1.88
L9=1.88
L10=5
L11=1.88
L12=0.94
L13=1.06
L14=0.56
L15=0.12
L16=0.25
L17=0.05

The thickness in the Z axis direction of each conductor of the antenna 125 is 0.018 μm. No balun is connected to the feeding point (end 112).

Second Embodiment

Figure 8:
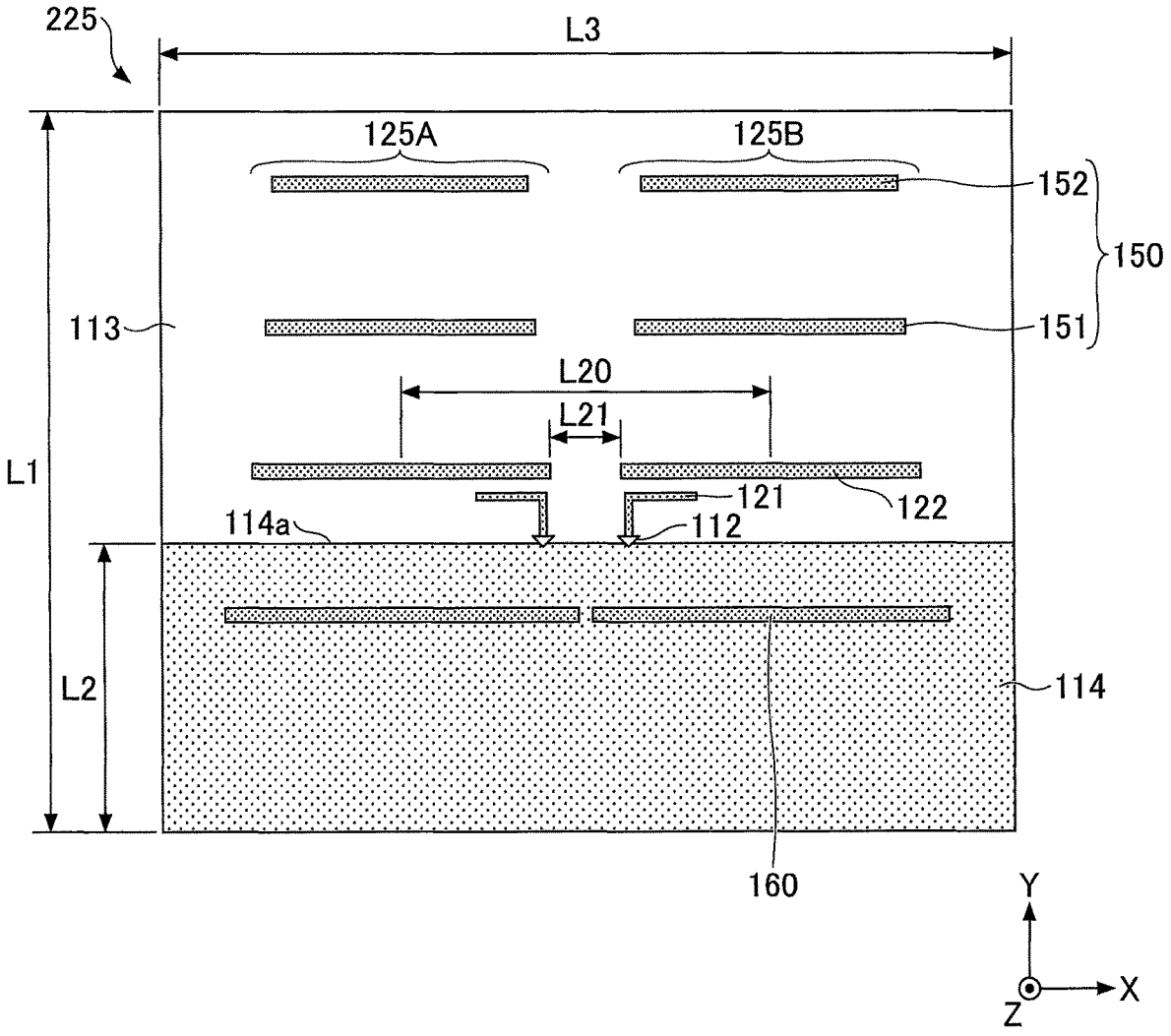
FIG. 8 is a plan view schematically illustrating a second embodiment of an antenna according to the present disclosure.

FIG. 8 is a plan view schematically illustrating a second embodiment of an antenna according to the present disclosure. In the configurations of the second embodiment, explanations about configurations similar to the above-described configurations are omitted or simplified by incorporating the above explanations herein by reference.

In FIG. 8, an antenna 225 is an example of a MIMO (Multiple Input and Multiple Output) antenna having multiple antennas of which feeding points are different from each other. The antenna 225 includes two antennas 125A, 125B. Each of the antennas 125A, 125B has the same configuration as the antenna 125 (see FIGS. 3, 4). The antennas 125A, 125B are arranged side by side in the X axis direction, and share the ground 114.

Figure 9:
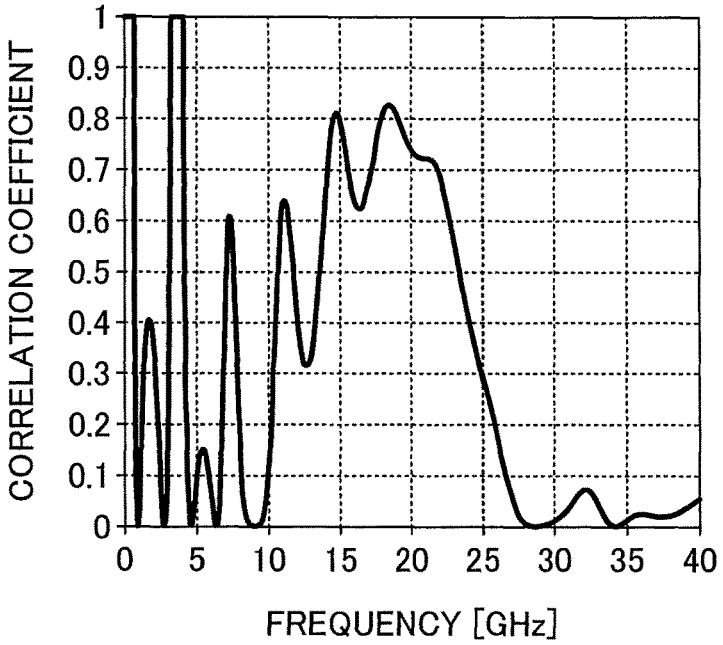
FIG. 9 is a drawing illustrating an example of a simulation result analyzing a correlation coefficient between antennas in the second embodiment of the antenna according to the present disclosure.

FIG. 9 is a drawing illustrating an example of a simulation result analyzing a correlation coefficient between the antenna 125A and the antenna 125B in the antenna 225. As illustrated in FIG. 9, the correlation coefficient is in a low state which is equal to or less than a predetermined value (for example, 0.3) in a bandwidth including the resonance frequency f(=28 GHz) of each of the antenna 125A and the antenna 125B. Therefore, the antenna 225 can be caused to function as a MIMO antenna for horizontal polarization.

Figure 10:
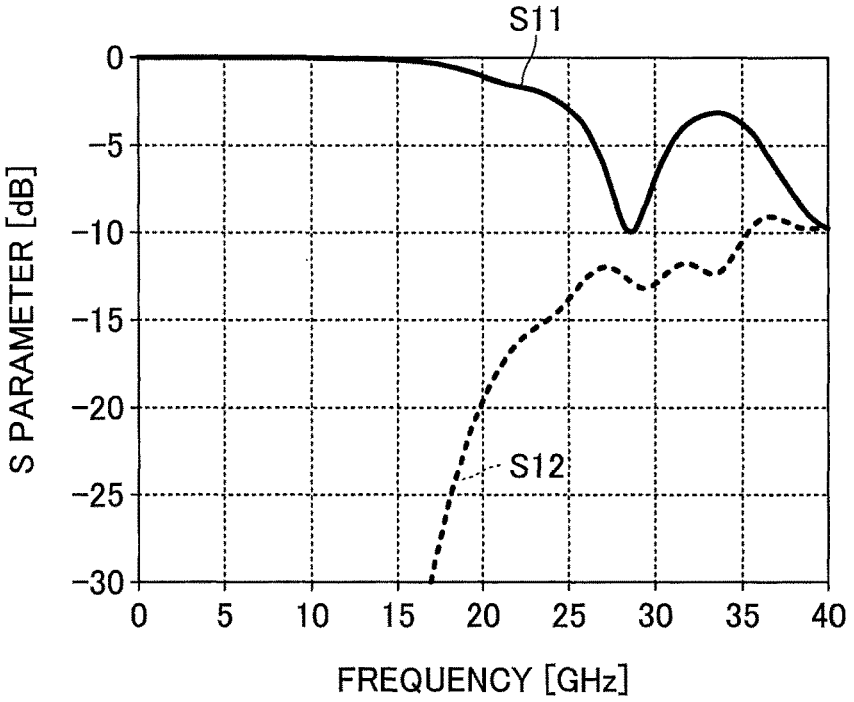
FIG. 10 is a drawing illustrating an example of a simulation analyzing return loss characteristics of the second embodiment of the antenna according to the present disclosure.

FIG. 10 is a drawing illustrating an example of a simulation analyzing return loss characteristics of the antenna 225. Microwave Studio (registered trademark) (CST) is used as electromagnetic simulation. The vertical axis represents a reflection coefficient S11 and a transmission coefficient S12 of S-parameters (Scattering parameters).

The frequency at which the transmission coefficient S12 becomes a local minimum is the frequency at which isolation between antennas can be increased (i.e., a frequency at which the correlation coefficient between antennas can be reduced).

In FIG. 10, the reflection coefficient S11 represents reflection characteristics of the antenna 125A. The transmission coefficient S12 represents a transmission coefficient from the antenna 125B to the antenna 125A. As illustrated in FIG. 10, in a bandwidth including the resonance frequency 28 GHz (for example, 25 to 30 GHz) of the antenna 225, the reflection coefficient S11 and the transmission coefficient S12 are suppressed to a low level. Therefore, the antenna 225 can be caused to function as a MIMO antenna having high degree of isolation between the antenna 125A and the antenna 125B at the resonance frequency 28 GHz.

Figure 11:
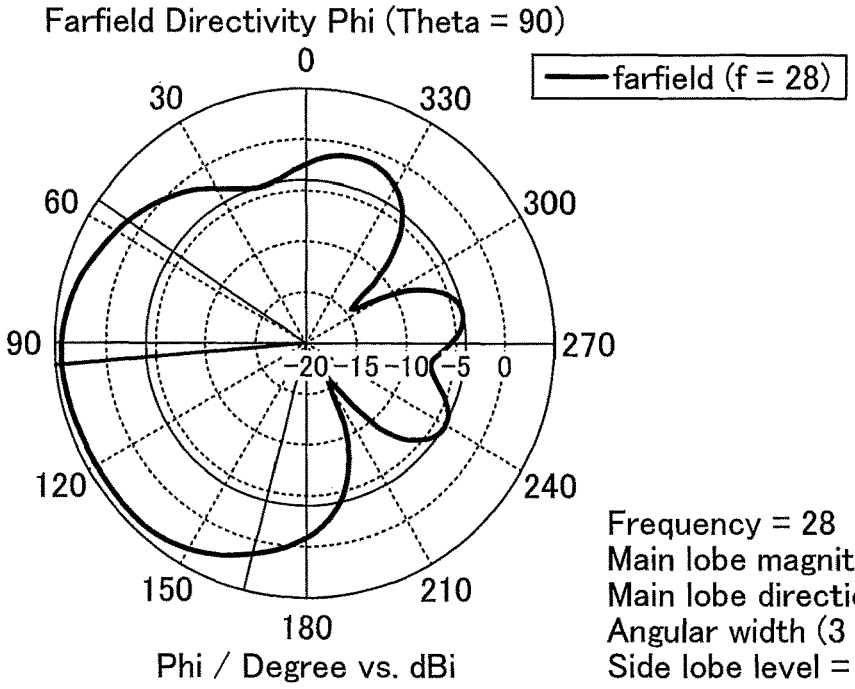
FIG. 11 is a drawing illustrating an example of a simulation result analyzing directivity within a horizontal plane when the second embodiment of the antenna according to the present disclosure is used in horizontal polarization.
Figure 12:
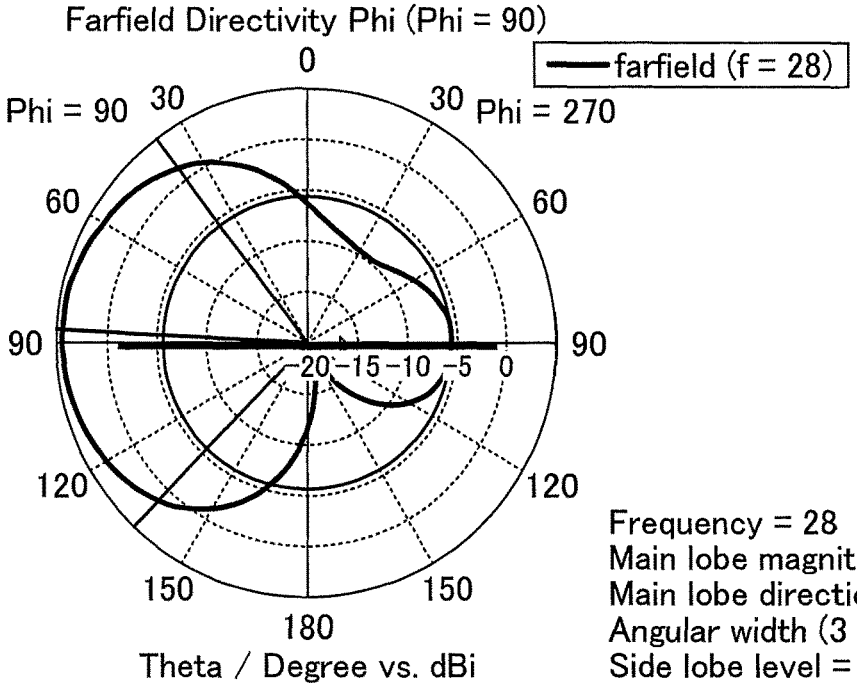
FIG. 12 is a drawing illustrating an example of a simulation result analyzing directivity within a vertical plane when the second embodiment of the antenna according to the present disclosure is used in horizontal polarization.

FIG. 11 is a drawing illustrating an example of a simulation result analyzing directivity within a horizontal plane when the antenna 225 is used in horizontal polarization. FIG. 12 is a drawing illustrating an example of a simulation result analyzing directivity within a vertical plane when the antenna 225 is used in horizontal polarization. FIGS. 11, 12 illustrate the directivity gains at the resonance frequency f(=28 GHz) in the fundamental mode of the antenna 225.

In the analysis of FIGS. 11, 12, a midpoint between one of the ends of the radiation element 122 of the antenna 125A and one of the ends of the radiation element 122 of the antenna 125B is defined as an origin where the X axis, the Y axis, and the Z axis intersect. "One of the ends of the radiation element 122" of each of the antennas 125A, 125B means an end close to the feeding element 121. φ (Phi) represents an angle formed by the X axis and any given direction within a plane including the X axis and the Y axis. θ (Theta) represents an angle formed by the Z axis and any given direction within a plane including the Z axis and the direction represented by φ.

As illustrated in FIGS. 11, 12, the antenna 225 having directivity at the positive side in the Y axis direction with respect to the two radiation elements 122 can be implemented. Therefore, since the antenna 225 is arranged such that the ground 114 is in parallel with the horizontal plane, the directivity at the positive side in the Y axis direction is improved in the direction in parallel with the horizontal plane (horizontal direction). Therefore, the antenna gain (operation gain) of horizontal polarization for reception from the positive side in the Y axis direction or radiation to the positive side in the Y axis direction can be increased.

It should be noted that, when the S parameters and the antenna gain are analyzed in FIGS. 9 to 12, the dimension of each unit illustrated in FIG. 8 is as follows, which is expressed in millimeters.

L1:10
L2:4
L3:12
L20:5.2
L21:1.08

The dimensions other than the above are the same as those of the first embodiment. No balun is connected to the two feeding points (ends 112).

Third Embodiment

Figure 13:
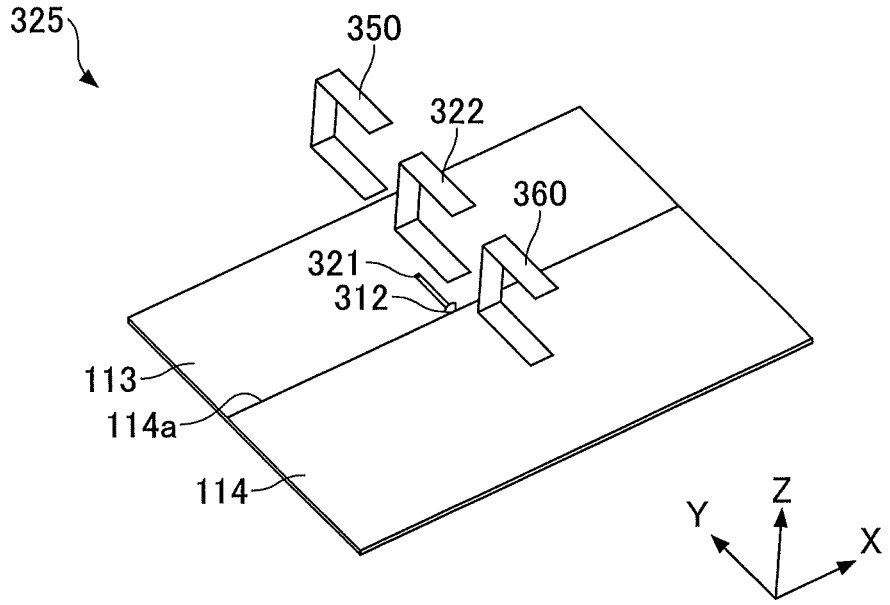
FIG. 13 is a perspective view schematically illustrating a third embodiment of an antenna according to the present disclosure.
Figure 14:
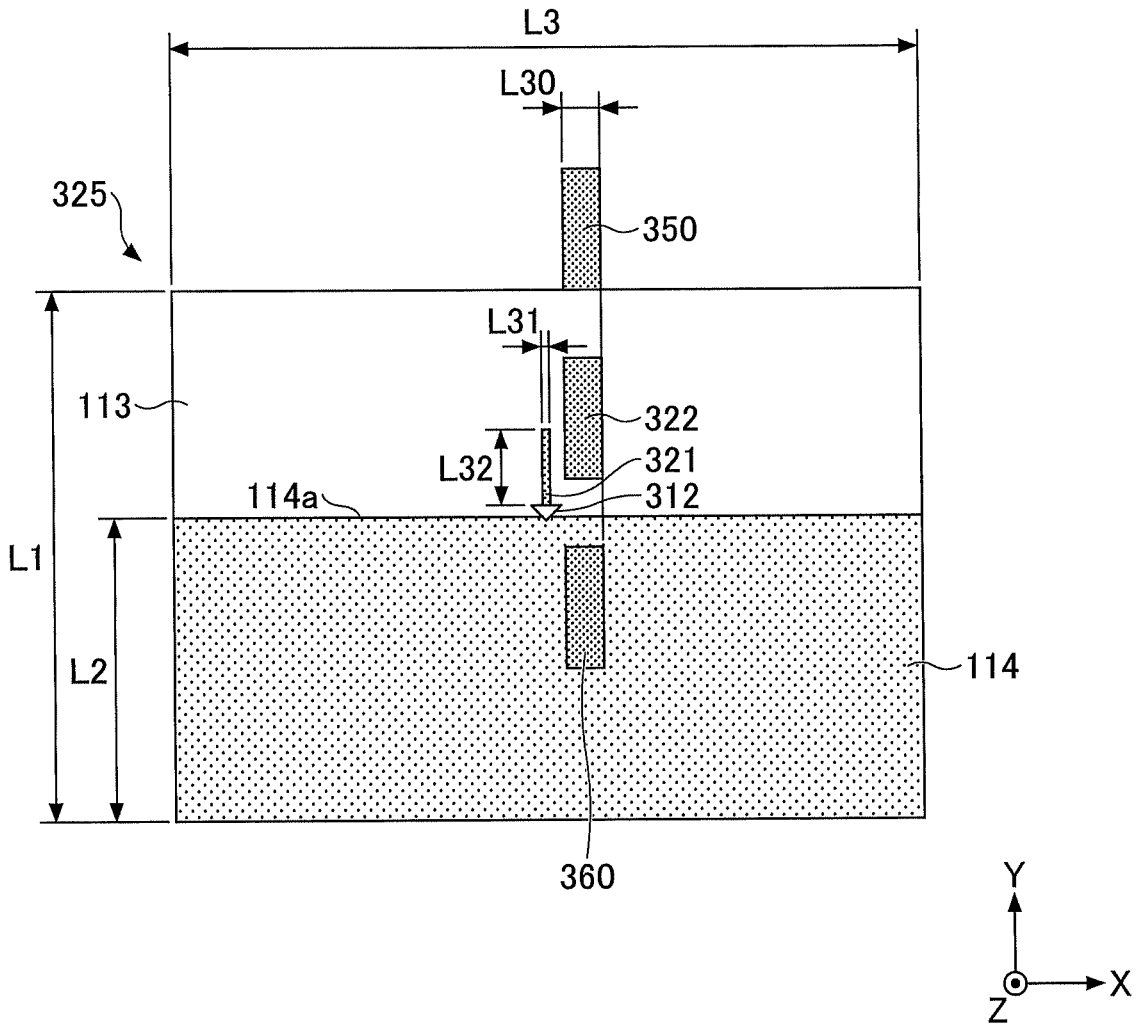
FIG. 14 is a plan view schematically illustrating the third embodiment of the antenna according to the present disclosure.
Figure 15:
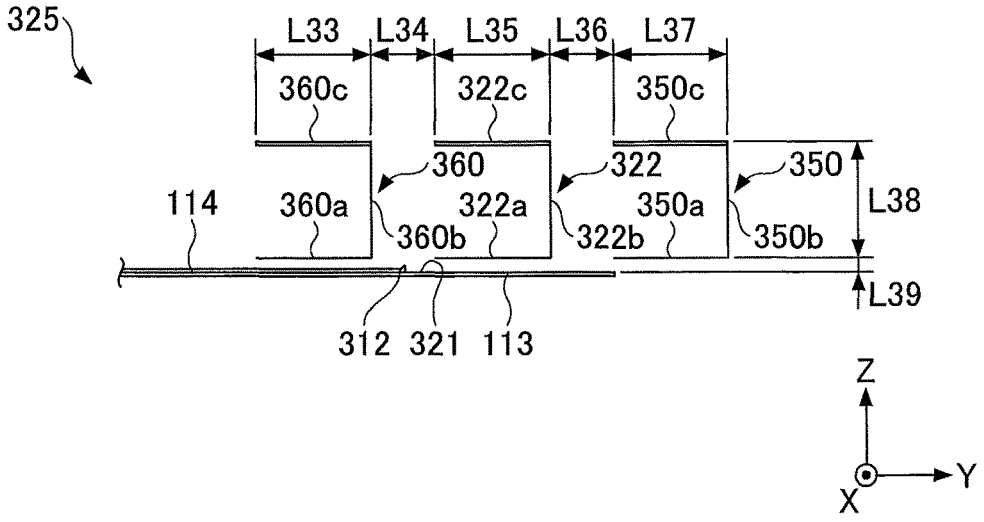
FIG. 15 is a side view schematically illustrating the third embodiment of the antenna according to the present disclosure.

FIG. 13 is a perspective view schematically illustrating a third embodiment of an antenna according to the present disclosure. FIG. 14 is a plan view schematically illustrating the third embodiment of the antenna according to the present disclosure. FIG. 15 is a side view schematically illustrating the third embodiment of the antenna according to the present disclosure. In the configurations of the third embodiment, explanations about configurations similar to the above-described configurations are omitted or simplified by incorporating the above explanations herein by reference.

In FIGS. 13 to 15, an antenna 325 is an example of the antenna 25 (see FIG. 1). The antenna 325 includes a ground 114, a feeding element 321, a radiation element 322, a director 350, and a reflector 360.

The ground 114 is an example of the ground 14 (see FIG. 1). The ground outer edge 114*a* is an example of the linear outer edge of the ground 114. The ground 114 is, for example, a ground pattern formed on the circuit board 113 in parallel with XY plane. The circuit board 113 is an example of the circuit board 13 (see FIG. 1). The feeding element 321 is an example of the feeding element 21 (see FIG. 1). The feeding element 321 is connected to an end 312 of a transmission line. The end 312 is an example of the feeding point with the ground 114 serving as the ground reference. The radiation element 322 is an example of the radiation element 22 (see FIG. 1). The radiation element 322 functions as a radiation conductor to which power is fed contactlessly through electromagnetic coupling with the feeding element 321. The director 350 is an example of the director 50 (see FIG. 1). In FIGS. 13 to 15, one director 350 is illustrated. The reflector 360 is an example of the reflector 60 (see FIG. 1).

In the antenna 325, the radiation element 322, the director 350, and the reflector 360 include conductor portions 322*b*, 360*b*, 350*b*, respectively, having directional components in parallel with the normal direction of the ground 114. Therefore, the antenna gain in the vertical polarization can be increased in a particular direction (in FIGS. 13 to 15, the positive side in the Y axis direction in parallel with the ground 114) with respect to the radiation element 22.

In FIGS. 13 to 15, the radiation element 322, the director 350, and the reflector 360 are conductors in U shape (including J shape). The opening portion of each of the U shapes is open toward the negative side in the Y axis direction, and, more specifically, the opening portion is open toward the side where the reflector 360 is arranged with respect to the radiation element 322.

The radiation element 322 includes a pair of conductor portions 322*a*, 322*c* facing each other in the Z axis direction and a conductor portion 322*b* connecting the ends at the positive side in the Y axis direction of the pair of conductor portions 322*a*, 322*c*. The pair of conductor portions 322*a*, 322*c* extend in the Y axis direction, and the conductor portion 322*b* extends in the Z axis direction.

The director 350 includes a pair of conductor portions 350*a*, 350*c* facing each other in the Z axis direction and a conductor portion 350*b* connecting the ends at the positive side in the Y axis direction of the pair of conductor portions 350*a*, 350*c*. The pair of conductor portions 350*a*, 350*c* extend in the Y axis direction, and the conductor portion 350*b* extends in the Z axis direction.

The reflector 360 includes a pair of conductor portions 360*a*, 360*c* facing each other in the Z axis direction and a conductor portion 360*b* connecting the ends at the positive side in the Y axis direction of the pair of conductor portions 360*a*, 360*c*. The pair of conductor portions 360*a*, 360*c* extend in the Y axis direction, and the conductor portion 360*b* extends in the Z axis direction.

In FIGS. 13 to 15, the antenna 325 includes the reflector 360 located at the side opposite to the director 350 with respect to the radiation element 322. Alternatively, the antenna 325 may use, as a reflector, the ground 114 located at the side opposite to the director 350 with respect to the radiation element 322. When the ground 114 is used as the reflector, the reflector 360 in FIGS. 13 to 15 may not be provided. Even in this case, the antenna 325 having a directivity in a particular direction (i.e., in FIGS. 13 to 15, the positive side in the Y axis direction in parallel with the ground 14) with respect to the radiation element 322 can be implemented.

Figure 16:
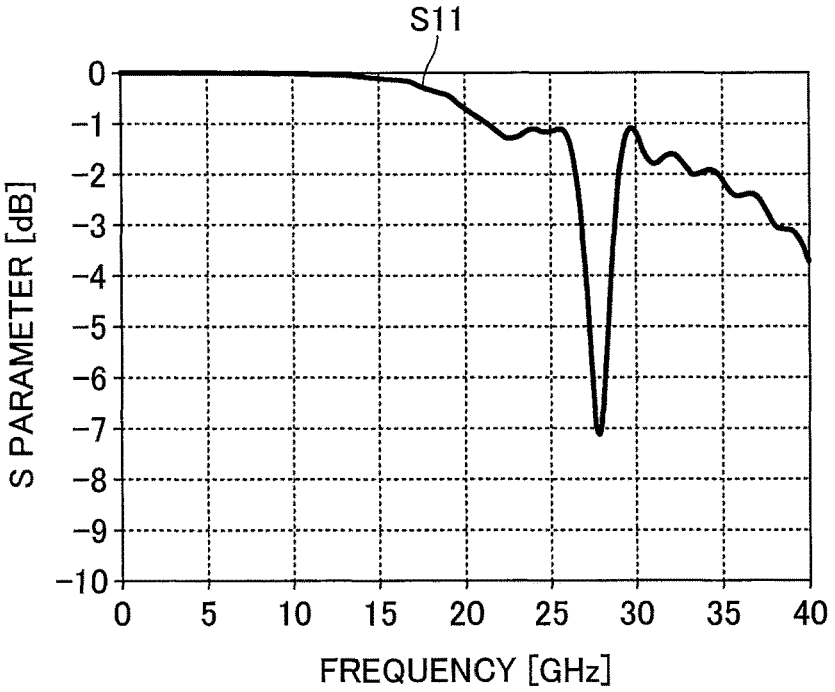
FIG. 16 is a drawing illustrating an example of a simulation analyzing return loss characteristics of the third embodiment of the antenna according to the present disclosure.

FIG. 16 is a drawing illustrating an example of a simulation analyzing return loss characteristics of the antenna 325. Microwave Studio (registered trademark) (CST) is used as electromagnetic simulation. The vertical axis represents a reflection coefficient S11 and a transmission coefficient S12 of S-parameters (Scattering parameters).

The frequency at which the reflection coefficient S11 becomes a local minimum is the frequency at which impedance matching can be attained, and this frequency can be adopted as the operation frequency (resonance frequency) of the antenna 325. As illustrated in FIG. 16, with the antenna 325, preferable impedance matching can be attained in a bandwidth including 28 GHz.

Figure 17:
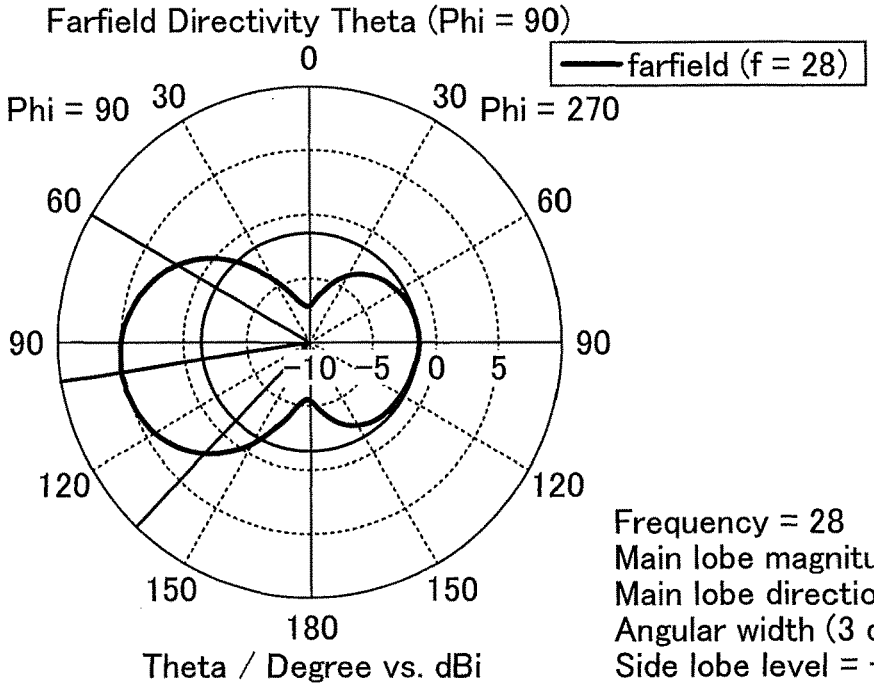
FIG. 17 is a drawing illustrating an example of a simulation result analyzing directivity within a vertical plane when the third embodiment of the antenna according to the present disclosure is used in vertical polarization.
Figure 18:
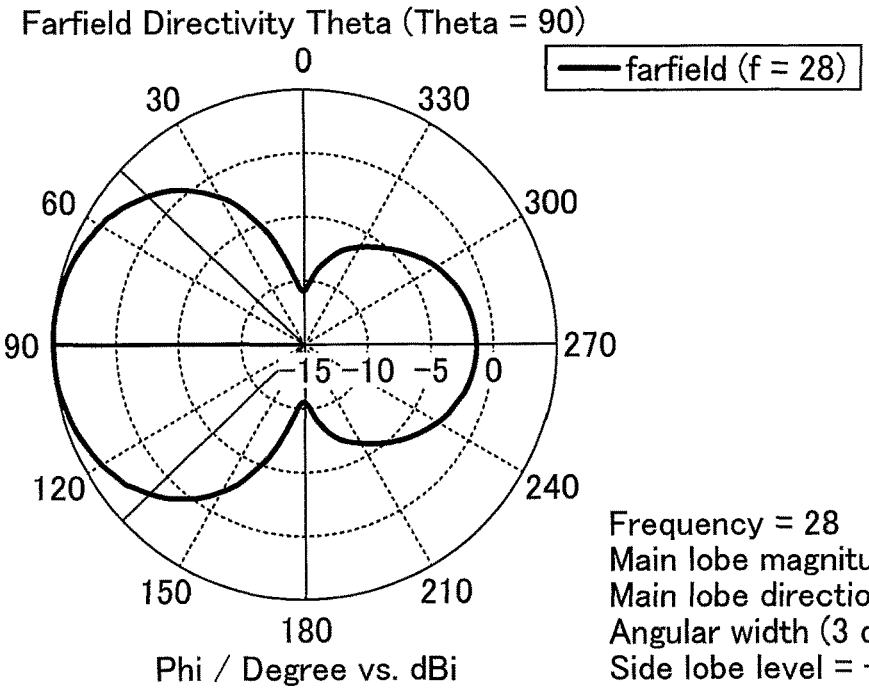
FIG. 18 is a drawing illustrating an example of a simulation result analyzing directivity within a horizontal plane when the third embodiment of the antenna according to the present disclosure is used in vertical polarization.

FIG. 17 is a drawing illustrating an example of a simulation result analyzing directivity within a vertical plane when the antenna 325 is used in vertical polarization. FIG. 18 is a drawing illustrating an example of a simulation result analyzing directivity within a horizontal plane when the antenna 325 is used in vertical polarization. FIGS. 17, 18 illustrate the directivity gains at the resonance frequency f(=28 GHz) in the fundamental mode of the antenna 325.

In the analysis of FIGS. 17, 18, an intersection of the ground outer edge 114*a* and the YZ plane including the radiation element 322, the director 350, and the reflector 360 is defined as an origin where the X axis, the Y axis, and the Z axis intersect. φ (Phi) represents an angle formed by the X axis and any given direction within a plane including the X axis and the Y axis. θ (Theta) represents an angle formed by the Z axis and any given direction within a plane including the Z axis and the direction represented by φ.

In FIGS. 17, 18, the antenna 325 having directivity at the positive side in the Y axis direction with respect to the radiation element 322 can be implemented. Therefore, since the antenna 325 is arranged such that the ground 114 is in parallel with the horizontal plane, the directivity at the positive side in the Y axis direction is improved in the direction in parallel with the horizontal plane (horizontal direction). Accordingly, the antenna gain (operation gain) of vertical polarization for reception from the positive side in the Y axis direction or radiation to the positive side in the Y axis direction can be increased.

It should be noted that, when the S parameters and the antenna gain are analyzed in FIGS. 16 to 18, the dimension of each unit illustrated in FIGS. 14, 15 is as follows, which is expressed in millimeters.

L1:10
L2:4
L3:12
L30:0.5
L31:0.12
L32:1
L33:1.61
L34:0.89
L35:1.61
L36:0.89
L37:1.61
L38:1.62
L39:0.191

The dimensions other than the above are the same as those of the first embodiment. No balun is connected to the two feeding points (ends 312).

Fourth Embodiment

Figure 19:
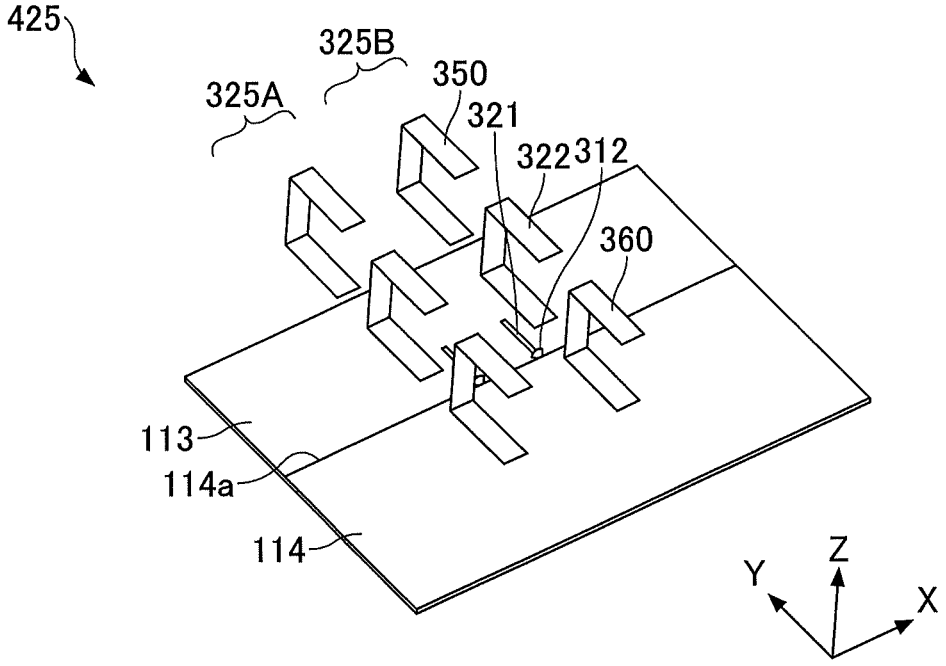
FIG. 19 is a perspective view schematically illustrating a fourth embodiment of an antenna according to the present disclosure.
Figure 20:
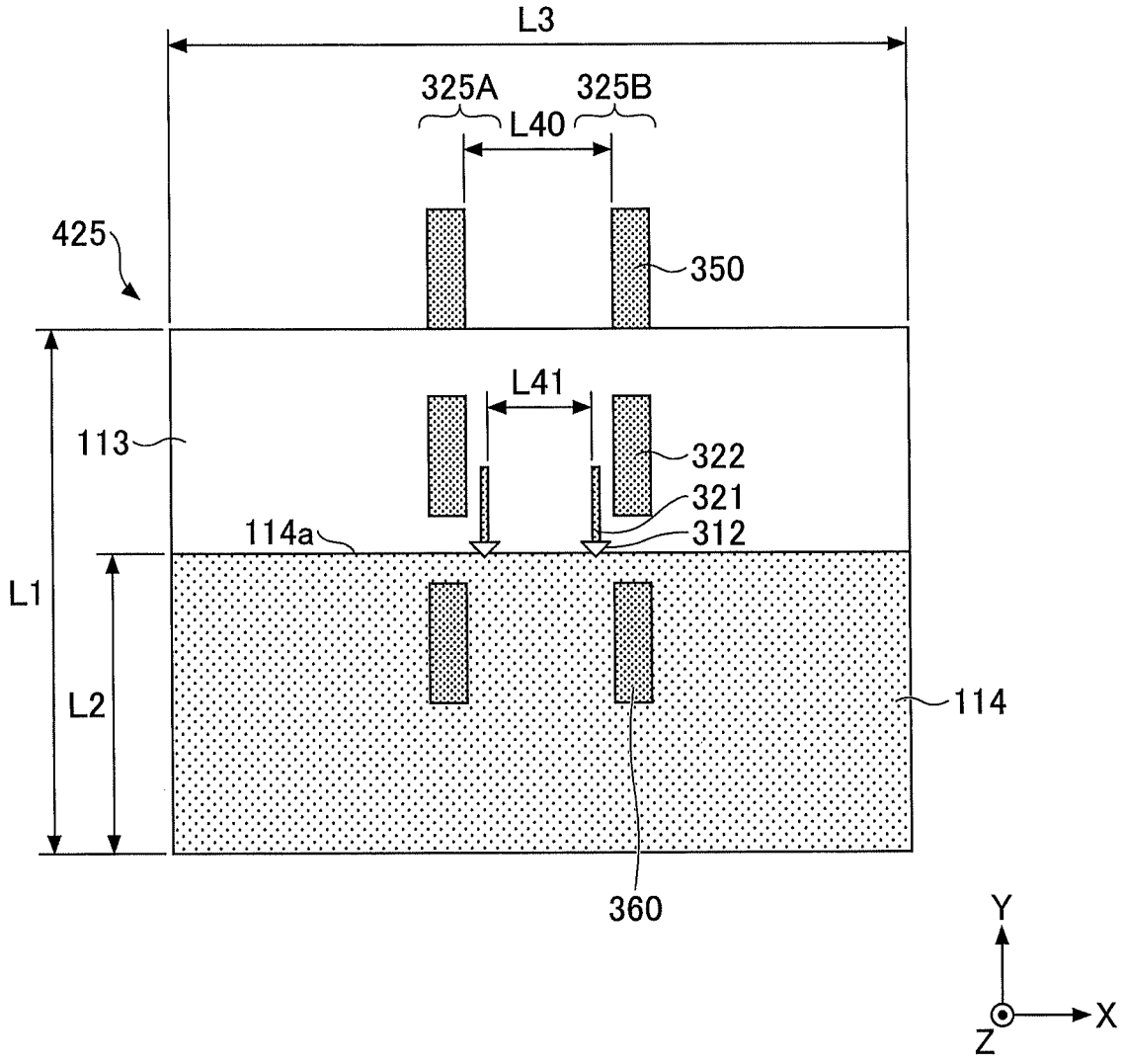
FIG. 20 is a plan view schematically illustrating the fourth embodiment of the antenna according to the present disclosure.

FIG. 19 is a perspective view schematically illustrating a fourth embodiment of an antenna according to the present disclosure. FIG. 20 is a plan view schematically illustrating the fourth embodiment of the antenna according to the present disclosure. In the configurations of the fourth embodiment, explanations about configurations similar to the above-described configurations are omitted or simplified by incorporating the above explanations herein by reference.

In FIGS. 19, 20, an antenna 425 is an example of a MIMO antenna having multiple antennas of which feeding points are different from each other. The antenna 425 includes two antennas 325A, 325B. Each of the antennas 325A, 325B has the same configuration as the antenna 325 (see FIGS. 13 to 15). The antennas 325A, 325B are arranged side by side in the X axis direction, and share the ground 114.

Figure 21:
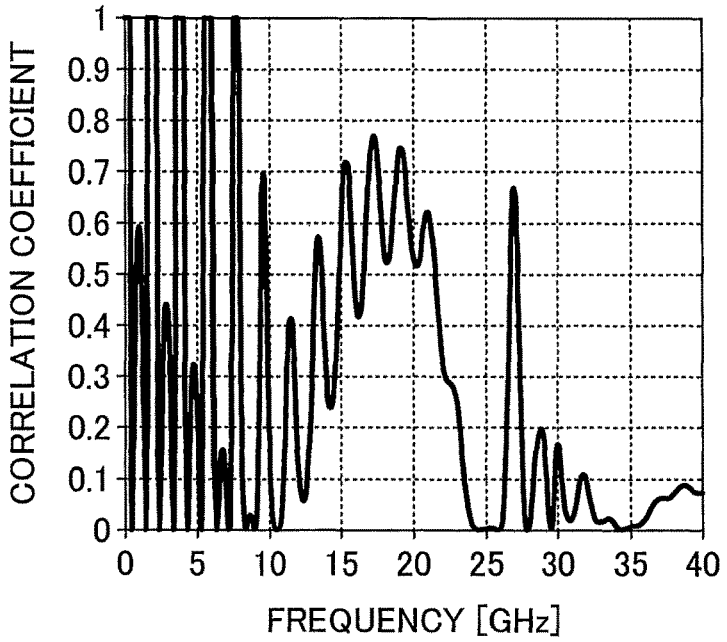
FIG. 21 is a drawing illustrating an example of a simulation result analyzing a correlation coefficient between antennas in the fourth embodiment of the antenna according to the present disclosure.

FIG. 21 is a drawing illustrating an example of a simulation result analyzing a correlation coefficient between the antenna 325A and the antenna 325B in the antenna 425. As illustrated in FIG. 21, the correlation coefficient is in a low state which is equal to or less than a predetermined value (for example, 0.3) in a bandwidth including the resonance frequency f(=28 GHz) of each of the antenna 325A and the antenna 325B. Therefore, the antenna 425 can be caused to function as a MIMO antenna for vertical polarization.

Figure 22:
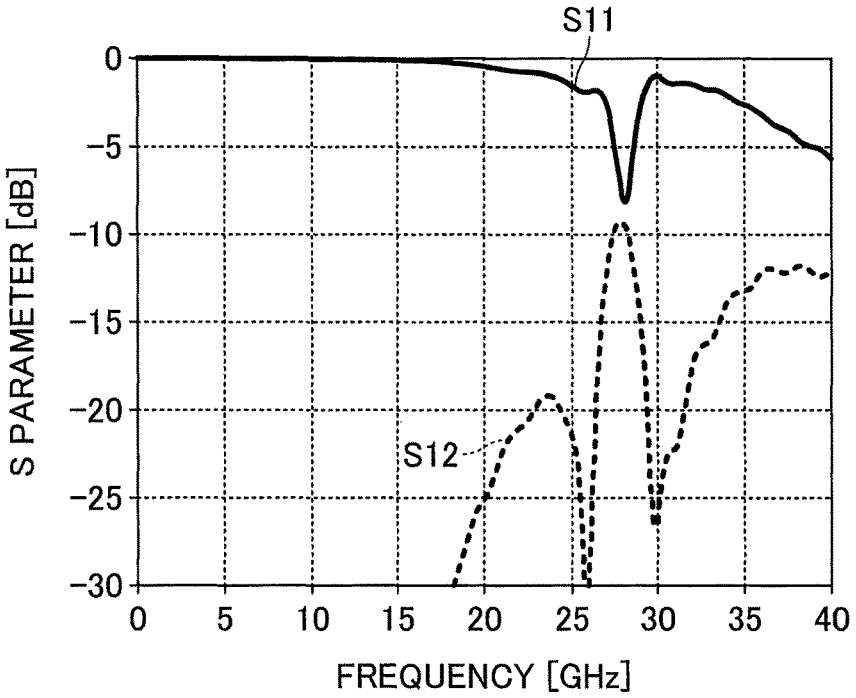
FIG. 22 is a drawing illustrating an example of a simulation analyzing return loss characteristics of the fourth embodiment of the antenna according to the present disclosure.

FIG. 22 is a drawing illustrating an example of a simulation analyzing return loss characteristics of the antenna 425. Microwave Studio (registered trademark) (CST) is used as electromagnetic simulation. The vertical axis represents a reflection coefficient S11 and a transmission coefficient S12 of S-parameters (Scattering parameters).

The frequency at which the reflection coefficient S11 becomes a local minimum is the frequency at which impedance matching can be attained, and this frequency can be adopted as the operation frequency (resonance frequency) of the antenna 425. The frequency at which the transmission coefficient S12 is sufficiently low is the frequency at which isolation between antennas can be increased (i.e., a frequency at which the correlation coefficient between antennas can be reduced).

In FIG. 22, the reflection coefficient S11 represents reflection characteristics of the antenna 325A. The transmission coefficient S12 represents a transmission coefficient from the antenna 325B to the antenna 325A. As illustrated in FIG. 22, in a bandwidth including the resonance frequency 28 GHz (for example, 25 to 30 GHz) of the antenna 425, the reflection coefficient S11 and the transmission coefficient S12 are suppressed to a low level. Therefore, the antenna 425 can be caused to function as a MIMO antenna having sufficient isolation performance between the antenna 325A and the antenna 325B at the resonance frequency 28 GHz.

It should be noted that, when the S parameters and the antenna gain are analyzed in FIGS. 21, 22, the dimension of each unit illustrated in FIG. 20 is as follows, which is expressed in millimeters.

L1:10
L2:4
L3:12
L40:2
L41:1.38

The dimensions other than the above are the same as those of the first embodiment. No balun is connected to the two feeding points (ends 312).

Fifth Embodiment

Figure 23:
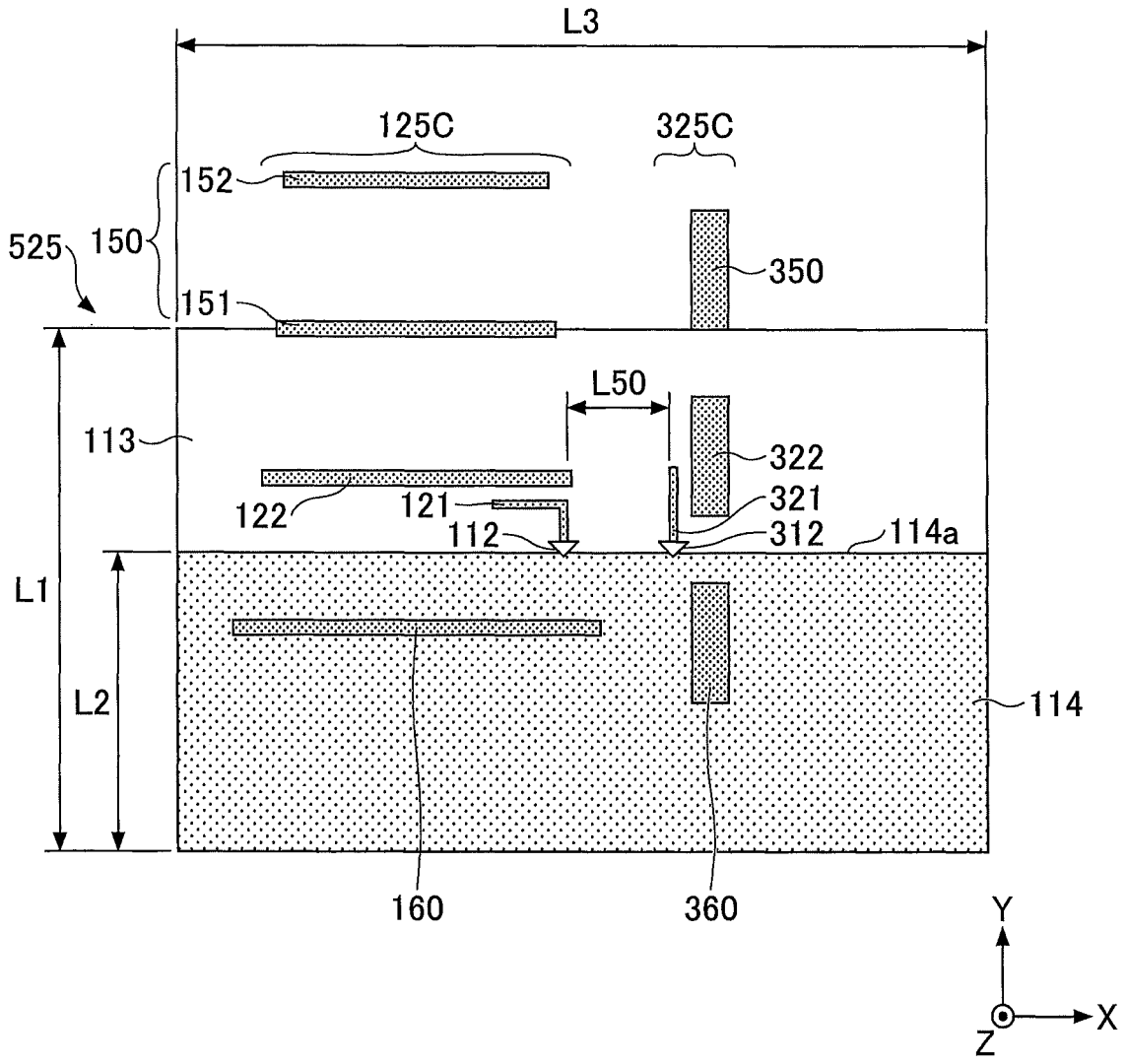
FIG. 23 is a plan view schematically illustrating a fifth embodiment of an antenna according to the present disclosure.

FIG. 23 is a plan view schematically illustrating a fifth embodiment of an antenna according to the present disclosure. In the configurations of the fifth embodiment, explanations about configurations similar to the above-described configurations are omitted or simplified by incorporating the above explanations herein by reference.

In FIG. 23, an antenna 525 is an example of a MIMO antenna having multiple antennas of which feeding points are different from each other. The antenna 525 includes two antennas 125C, 325C. The antenna 125C is an example of a first antenna having the same configuration as the antenna 125 (see FIGS. 3, 4). The antenna 325C is an example of a second antenna having the same configuration as the antenna 325 (see FIGS. 13 to 15). The antennas 125C, 325C are arranged side by side in the X axis direction, and share the ground 114.

In the antenna 125C, the radiation element 122, the director 150, and the reflector 160 include respective conductor portions having directional components in parallel with the ground 114. On the other hand, in the antenna 325C, the radiation element 322, the director 350, and the reflector 360 include respective conductor portions having directional components in parallel with the normal direction of the ground 114.

Figure 24:
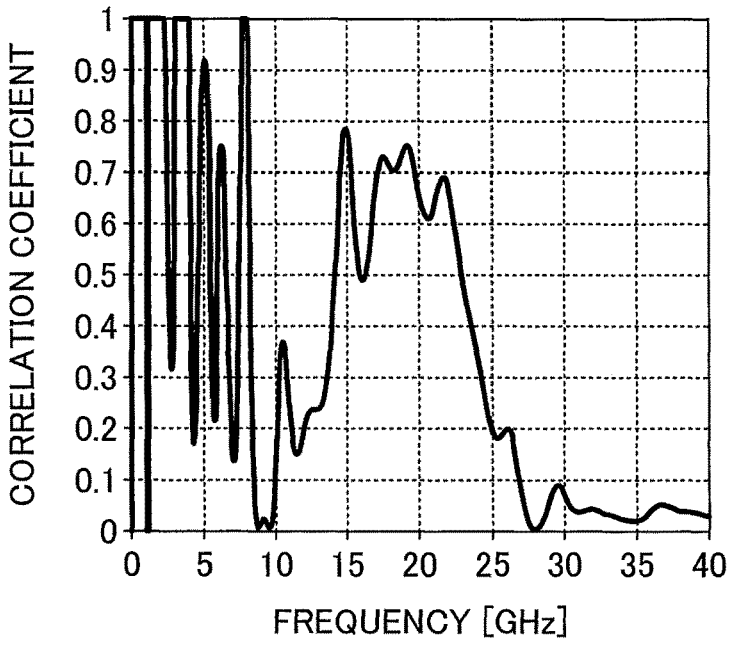
FIG. 24 is a drawing illustrating an example of a simulation result analyzing a correlation coefficient between antennas in the fifth embodiment of the antenna according to the present disclosure.

FIG. 24 is a drawing illustrating an example of a simulation result analyzing a correlation coefficient between the antenna 125C and the antenna 325C in the antenna 525. As illustrated in FIG. 24, the correlation coefficient is in a low state which is equal to or less than a predetermined value (for example, 0.3) in a bandwidth including the resonance frequency f(=28 GHz) of each of the antenna 125C and the antenna 325C. Therefore, the antenna 525 can be caused to function as a MIMO antenna capable of supporting both of horizontal polarization and vertical polarization.

Figure 25:
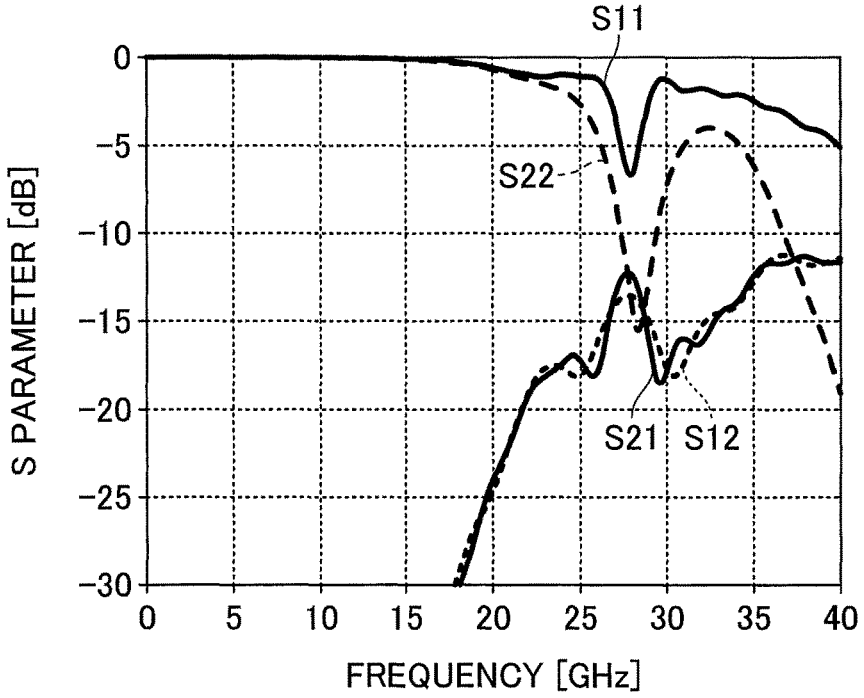
FIG. 25 is a drawing illustrating an example of a simulation analyzing return loss characteristics of the fifth embodiment of the antenna according to the present disclosure.

FIG. 25 is a drawing illustrating an example of a simulation analyzing return loss characteristics of the antenna 525. Microwave Studio (registered trademark) (CST) is used as electromagnetic simulation. The vertical axis represents reflection coefficients S11, S22 and transmission coefficients S12, S21 of S-parameters (Scattering parameters).

The frequency at which the reflection coefficients S11, S22 become a local minimum is the frequency at which impedance matching can be attained, and this frequency can be adopted as the operation frequency (resonance frequency) of the antenna 525. The frequency at which the transmission coefficients S12, S21 become a local minimum is the frequency at which isolation between antennas can be increased (i.e., a frequency at which the correlation coefficient between antennas can be reduced).

In FIG. 25, the reflection coefficients S11, S22 represent reflection characteristics of the antennas 125C, 325C. The transmission coefficient S12 represents a transmission coefficient from the antenna 325C to the antenna 125C. The transmission coefficient S21 represents a transmission coefficient from the antenna 125C to the antenna 325C. As illustrated in FIG. 25, in a bandwidth including the resonance frequency 28 GHz (for example, 25 to 30 GHz) of the antenna 525, the reflection coefficients S11, S22 and the transmission coefficients S12, S21 are suppressed to a low level. Therefore, the antenna 525 can be caused to function as a MIMO antenna having high degree of isolation between the antenna 125C and the antenna 325C at the resonance frequency 28 GHz.

It should be noted that, when the S parameters and the antenna gain are analyzed in FIGS. 24, 25, the dimension of each unit illustrated in FIG. 23 is as follows, which is expressed in millimeters.

L1:10
L2:4
L3:12
L50:1.38

The dimensions other than the above are the same as those of the first and third embodiments. No balun is connected to the two feeding points (ends 112, 312).

Although the antenna and the MIMO antenna have been hereinabove described with reference to the embodiments, the present invention is not limited to the above embodiments. Various modifications and improvements such as combinations of and substitutions with some or all of the other embodiments are possible within the scope of the present invention.

What is claimed is:

1. An antenna, comprising:
a substrate;
a base plate positioned to face the substrate;
a ground plane formed on a surface of the substrate;
a first resonator formed on the surface of the substrate and connected to a feeding point for which the ground plane serves as a reference;
a second resonator configured to receive power from the first resonator through electromagnetic coupling or magnetic coupling in a contactless manner; and
at least one director positioned away from the first resonator and the second resonator,
wherein the ground plane is formed such that the ground plane is configured to be a reflector, and the director and the second resonator are formed on a surface of the base plate facing the substrate.

2. The antenna according to claim 1, wherein the ground plane is formed at a side opposite to the director with respect to the first resonator.

3. The antenna according to claim 1, further comprising:
a second reflector formed on an opposite side to the director with respect to the second resonator.

4. The antenna according to claim 3, wherein the second resonator, the director, and the second reflector include respective conductor portions having directional components in parallel with a normal direction of the ground plane.

5. The antenna according to claim 1, wherein the director includes a conductor portion having a directional component.

6. The antenna according to claim 1, wherein the director includes a plurality of directing elements comprising a plurality of conductor portions having a directional component.

7. The antenna according to claim 1, wherein the second resonator comprises a conductor portion, and the director includes a plurality of directing elements comprising a plurality of conductor portions having a directional component such that a length of each of the directing elements is in a range of 0.8 to 0.99 times a length of the second resonator.

8. The antenna according to claim 4, wherein the director includes a plurality of directing elements comprising the respective conductor portions having the directional components such that a length of each of the directing elements is in a range of 0.8 to 0.99 times a length of the second resonator.

9. The antenna according to claim 3, wherein the second resonator, the director, and the second reflector include respective conductor portions having directional components in parallel with a normal direction of the ground plane such that the second resonator and the director is separated by a distance in a range of 0.2λ to 0.3λ where λ is a wavelength in resonance.

10. The antenna according to claim 1, wherein the director includes a plurality of directing elements comprising a plurality of conductor portions having a directional component in parallel with a normal direction of the ground plane such that the directing elements are separated by a distance in a range of 0.2λ to 0.3λ where λ is a wavelength in resonance.

11. The antenna according to claim 9, wherein the director includes a plurality of directing elements comprising a plurality of conductor portions having a directional component in parallel with a normal direction of the ground plane such that the directing elements are separated by a distance in a range of 0.2λ to 0.3λ where λ is a wavelength in resonance.

12. The antenna according to claim 3, wherein the second reflector is formed such that a length of the second reflector is longer than a length of the second resonator.

13. The antenna according to claim 7, wherein the second reflector is formed such that a length of the second reflector is longer than a length of the second resonator.

14. The antenna according to claim 3, wherein the second resonator, the director, and the second reflector include respective conductor portions having directional components in parallel with a normal direction of the ground plane such that an antenna gain in a horizontal polarization increases in a particular direction with respect to the second resonator.

15. The antenna according to claim 3, wherein the second resonator, the director, and the second reflector include respective conductor portions having directional components in parallel with a normal direction of the ground plane such that the second resonator and the reflector is separated by a distance in a range of 0.2λ to 0.3λ where λ is a wavelength in resonance.

16. The antenna according to claim 1, further comprising:

a second reflector formed such that the second resonator faces the ground plane on an opposite side to the director with respect to the first resonator.

17. The antenna according to claim 3, wherein the second reflector is formed on the surface of the base plate facing the substrate.

18. The antenna according to claim 2, further comprising:

a second reflector formed on an opposite side to the director with respect to the second resonator.

19. A MIMO antenna, comprising:

a plurality of antennas having feeding points different from each other, wherein each of the plurality of antennas comprises a substrate, a base plate positioned to face the substrate, a ground plane formed on a surface of the substrate, a first resonator formed on the surface of the substrate and connected to a feeding point for which the ground plane serves as a reference, and a second resonator configured to receive power from the first resonator through electromagnetic coupling or magnetic coupling in a contactless manner, and at least one director positioned away from the first resonator and the second resonator, the ground plane is formed such that the ground plane is configured to be a reflector, and the director and the second resonator are formed on a surface of the base plate facing the substrate.

20. The MIMO antenna according to claim 19, further comprising:

a second reflector formed on an opposite side to the director with respect to the first resonator, wherein the plurality of antennas includes a first antenna and a second antenna, the first antenna includes the second resonator, the director, and the second reflector that include respective conductor portions having directional components in parallel with the ground plane, and the second antenna includes the second resonator, the director, and the second reflector that include respective conductor portions having directional components in parallel with a normal direction of the ground plane.

* * * * *